US010675501B2

(12) United States Patent
Vorozilchak

(10) Patent No.: US 10,675,501 B2
(45) Date of Patent: Jun. 9, 2020

(54) ADJUSTABLE EXERCISE SUSPENSION SYSTEM AND RELATED METHODS

(71) Applicant: DV LV Limited, Wilkes Barre, PA (US)

(72) Inventor: David Vorozilchak, Shavertown, PA (US)

(73) Assignee: DV LV LIMITED, Wilkes Barre, PA (US)

( * ) Notice: Subject to any disclaimer, the term of this patent is extended or adjusted under 35 U.S.C. 154(b) by 116 days.

(21) Appl. No.: 15/949,402

(22) Filed: Apr. 10, 2018

(65) Prior Publication Data

US 2018/0290007 A1 Oct. 11, 2018

Related U.S. Application Data

(60) Provisional application No. 62/483,634, filed on Apr. 10, 2017.

(51) Int. Cl.

| | |
|---|---|
| ***A63B 21/16*** | (2006.01) |
| ***A63B 21/072*** | (2006.01) |
| ***A63B 21/00*** | (2006.01) |
| ***A63B 21/06*** | (2006.01) |
| ***A63B 7/00*** | (2006.01) |
| ***A63B 21/08*** | (2006.01) |

(52) U.S. Cl.

CPC ..... *A63B 21/1681* (2013.01); *A63B 7/00* (2013.01); *A63B 21/06* (2013.01); *A63B 21/0726* (2013.01); *A63B 21/4035* (2015.10); *A63B 21/08* (2013.01); *A63B 2225/09* (2013.01)

(58) Field of Classification Search

CPC ..... A63B 21/1681; A63B 21/4035; A63B 21/0726; A63B 2225/09; A63B 21/08; A63B 21/06; A63B 7/00

See application file for complete search history.

(56) References Cited

U.S. PATENT DOCUMENTS 2,648,540 A * 8/1953 Hunter ..... A63B 1/005 482/102
4,109,907 A * 8/1978 Zito ..... A63B 21/06 482/904
4,355,801 A * 10/1982 Thomsen ..... A63B 21/065 482/105

(Continued)

*Primary Examiner* — Garrett K Atkinson
(74) *Attorney, Agent, or Firm* — The Belles Group, P.C.

(57) ABSTRACT

An adjustable exercise suspension system and related methods of use and exercise are disclosed. The system includes a length-adjustable suspension strap assembly attached at one end to a fixed overhead support structure and at an opposite end to a weight element. The strap assembly comprises a plurality of straps detachably connected together. The weight element is suspended from the overhead support structure creating a tensile force in the strap assembly establishing a taut condition. The weight element is manually movable by a user during the exercise routine along an arcuate path in a plane of stable motion while the tensile force maintains the taut condition of the strap assembly. The strap assembly advantageously provides guided and stabilized motion of the weight element for the user thereby minimizing risk of injury. The resistance force of the system is user-variable by attaching different size weight elements to the strap assembly.

22 Claims, 23 Drawing Sheets

(56) References Cited

U.S. PATENT DOCUMENTS 4,700,944 A * 10/1987 Sterba ..... A63B 21/0615 482/106
4,826,153 A * 5/1989 Schalip ..... A63B 21/06 482/94
4,998,723 A * 3/1991 Santoro ..... A63B 21/078 482/104
5,072,934 A * 12/1991 Blanes ..... A63B 21/1627 482/904
5,269,512 A * 12/1993 Crowson ..... A63B 21/153 473/229
5,511,775 A * 4/1996 Parks ..... A63B 63/00 473/454
5,588,940 A * 12/1996 Price ..... A63B 21/065 224/259
5,743,838 A * 4/1998 Willis ..... A63B 21/0552 482/124
6,322,483 B1 * 11/2001 Rotella ..... A63B 21/0552 482/121
6,461,281 B2 * 10/2002 Bouvier ..... A63B 69/201 482/83
6,666,802 B1 * 12/2003 Rasmussen ..... A63B 21/0608 482/140
6,921,354 B1 * 7/2005 Shifferaw ..... A63B 21/068 482/126
7,083,554 B1 * 8/2006 Lo Presti ..... A63B 21/155 482/100
7,381,169 B2 * 6/2008 Pearson ..... A63B 21/065 482/105
8,444,537 B1 * 5/2013 Santoro ..... A63B 21/078 482/104
8,721,505 B2 * 5/2014 Conarty ..... A63B 69/20 482/89
8,858,408 B2 * 10/2014 DeMeo ..... A63B 21/00185 482/131
8,968,165 B2 * 3/2015 Becker ..... A63B 21/0728 482/107
9,469,387 B2 * 10/2016 Pajonk-Taylor ..... B63B 59/02
9,504,867 B2 * 11/2016 Hall ..... A63B 21/0726
9,573,015 B2 * 2/2017 Hall ..... A63B 21/0726
9,597,544 B1 * 3/2017 Emick ..... F16M 11/10
9,630,044 B2 * 4/2017 Nelson ..... A63B 21/065
9,931,532 B2 * 4/2018 Castaneda ..... A63B 23/02
10,357,701 B2 * 7/2019 Jones ..... A63B 69/205
2002/0010057 A1 * 1/2002 Bouvier ..... A63B 69/201 482/86
2006/0135327 A1 * 6/2006 Pearson ..... A63B 21/065 482/105
2007/0155598 A1 * 7/2007 Warren ..... A63B 21/075 482/105
2011/0251033 A1 * 10/2011 Blancher ..... A63B 21/0442 482/123
2012/0238416 A1 * 9/2012 Becker ..... A63B 21/0728 482/107
2012/0289382 A1 * 11/2012 Haddad ..... A63B 69/0024 482/93
2012/0322627 A1 * 12/2012 Emerson ..... A63B 21/075 482/93
2013/0065735 A1 * 3/2013 Conarty ..... A63B 69/20 482/89
2013/0143724 A1 * 6/2013 DeMeo ..... A63B 21/00185 482/131
2013/0212898 A1 * 8/2013 Reynolds ..... G09F 1/10 34/239
2013/0316880 A1 * 11/2013 Bosse ..... A63B 21/0728 482/107
2014/0256519 A1 * 9/2014 Nelson ..... A63B 21/065 482/105
2015/0024908 A1 * 1/2015 Hall ..... A63B 21/0726 482/93
2015/0057132 A1 * 2/2015 Pedone ..... A63B 69/004 482/83
2015/0182777 A1 * 7/2015 Rarity, IV ..... A63B 21/0602 482/93
2016/0016032 A1 * 1/2016 Haddad ..... A63B 21/4043 482/93
2016/0039502 A1 * 2/2016 Pajonk-Taylor ..... B63B 59/02 114/219
2016/0166910 A1 * 6/2016 Adams, Jr. ..... A63B 69/205 482/86
2016/0206943 A1 * 7/2016 Campbell ..... A63B 69/004
2017/0014670 A1 * 1/2017 Hall ..... A63B 21/0726
2017/0087435 A1 * 3/2017 Jones ..... A63B 69/206
2017/0252628 A1 * 9/2017 Jones ..... A63B 69/205
2017/0326403 A1 * 11/2017 Castaneda ..... A63B 23/02
2018/0296897 A1 * 10/2018 Horn ..... A63B 69/002
2019/0217176 A1 * 7/2019 Slechta ..... A63B 69/20
2019/0282880 A1 * 9/2019 Bortolotto ..... A63B 69/201

* cited by examiner

ADJUSTABLE EXERCISE SUSPENSION SYSTEM AND RELATED METHODS

CROSS REFERENCE TO RELATED APPLICATIONS

The present application claims the benefit of priority to U.S. Provisional Application 62/483,634 filed Apr. 10, 2017; the entirety of which is incorporated herein by reference.

BACKGROUND OF THE INVENTION

The present invention relates to an adjustable exercise suspension system with a hanging weight to improve exercises and techniques for functional training, full body strength, mobility, flexibility, core strength, and other fitness workouts. Related methods for using the suspension system and exercising are also disclosed.

Numerous types of resistance training approaches have been used in the past for improving strength by targeting various muscle groups. One category of weight training equipment relies on a separate weight element of some type which provides the resistance. Weight lifting with "free weights" is highly favored for effectively working a great variety of muscle groups due to the unrestricted directional motions possible and involvement of the user's core. Free weight lifting uses barbells or dumbbells which the user must completely handle and stabilize on their own during the exercise motion. Although there is a wide range of exercise motions possible to work different muscle groups, some inexperienced or older users may have difficulty using and controlling the weight. This increases the risk of injury by either accidentally dropping the weight or overextension of the body part involved into an awkward position which may cause muscle or tendon tears.

Other lifting equipment utilizes a stack of confined weight plates which are restricted to vertical up/down movement by a rack. The weight stack is coupled to a cable pulley system including handles which are moved by a seated user to raise and lower the stack of weight plates. The range of exercise motion and groups of muscles which can be targeted is thus very limited, thereby requiring a specialized machine for each type of weight lifting exercise performed. This can become an expensive proposition particularly for a home user.

Another category of weight training equipment relies solely on resistance created by the user's own body weight for exercising. This includes various types of strap systems in which the straps are attached to some fixed object and the user holds the ends of the straps while pulling or lifting themselves against their own weight which provides the resistance. Resistance in this type system is thus limited by the user's own weight. In addition, traditional movements required in body weight strap training are foreign and awkward to infrequent exercisers compared to single muscle group focused exercises on plate loaded or selectively specialized weight machines. Although the only resistance is body weight, it is often difficult to maintain proper form and technique because of the high amount of core strength required to stabilize the entire body. Such conventional strap systems are therefore better adapted for use by advanced exercisers.

Yet another category of weight training equipment used substantially stretchable elastic rubber-like bands having an elastic memory to provide resistance for exercising. Such systems are limited by the elastic properties of the bands (e.g. spring constant). In addition, the variety of exercise motions and muscle groups which can be worked is very limited.

Improvements are desired in weight training equipment.

SUMMARY OF THE INVENTION

The present invention provides an adjustable exercise suspension system which overcomes the shortcomings of the prior exercise systems described above by replicating aspects of a free weight workout but with a degree of guided stable motion. The system generally includes a weight element suspended from one end of a length adjustable suspension strap assembly in a pendulum-like and stabilized manner. The other end of the suspension strap assembly which is attached to a fixed overhead support structure. The weight element provides the exercise resistance force and is interchangeable to allow the weight to be increased or decreased as desired by the user. During the weight lifting exercise routine, the user manually moves the suspended weight element from a first position to a second position. The weight element will follow an arcuate path attributable to the tensile force created in the suspension strap assembly by the weight which maintains the suspension strap assembly in a taut condition. The weight element is always supported at least partially by the suspension strap assembly during the exercise movement. Advantageously, the suspension strap assembly provides guided motion of the weight element in at least one plane of stability, thereby assisting the user and reducing risk of injury unlike handling "free weights." If the user becomes fatigued or grip on the weight element slips, the suspension strap assembly holds the weight to eliminate drops which can be dangerous. Because the suspension strap assembly is typically used while the user's feet maintain some contact with the floor, the core of the user is always involved during the weight lifting routine to some degree which enhances the strength training benefits.

The present suspension strap assembly is designed to guide the user through free flowing strength exercises that are low impact and non-restrictive. With the freedom to add as much weight as desired and guided motion of the weight, the suspension strap assembly is advantageously functional for everything from physical therapy and rehabilitation, modest exercising, and high intensity performance workouts. A multi-axis pivot point formed by the overhead anchorage of the suspension strap assembly provides freedom of movement of the weight by the user with the added benefit of safely guided motion of the weight.

The exercise suspension system may typically be mounted to an overhead ceiling (via an anchor of some type), power rack, pull-up bar, rig, or other available support structure. A detachable weight strap connected to the bottom of the length adjustable suspension strap assembly of the suspension system is detachable, and can easily and securely wrap around a kettle bell, dumbbell, weight plate, or other form of common weight elements found in fitness centers. The detachable weight strap connects the weight element to the suspension strap assembly which freely suspends the weight above the ground or floor. Once the weight is suspended above the floor, the suspension strap assembly allows the user to move the weight freely in a guided manner assisted by the suspension strap assembly along the arcuate path in multiple directions and positions to perform many different exercises. The suspension system also allows the user to release or throw the weight away from the body as it automatically swings back to the vertical and returns to the user via pendulum action. This methodology is ideal for explosive, coordinated, and repetitive exercises.

When the weight element is moved away from the vertical axis of the suspension system, the downward force from gravity is divided between the suspension strap assembly and the user relative to the angle between the weight element and the vertical axis. When the user moves the weight element along arcuate path of travel during an exercise motions, the tensile force created in the suspension strap assembly by the weight element decreases with an increasing angle to the vertical axis because the user is providing an increasing amount of support which works the target muscle group.

The adjustable suspension system with hanging weight allows the user to simulate free weight training with a certain degree of restriction and control thereby providing a plane of stability that adds safety and control to the exercises. At a controlled height, the suspended weight element creates a unique and safe apparatus for an effective workout that gives users a greater sense of accomplishment and enjoyment in addition to the standard body weight suspension training exercises.

With the ability to attach weights of different sizes, the exercise suspension system disclosed herein allows users to vary the forces of gravity exerted on the user in several different manners: (1) Different size weights; (2) The angle of the weight along the suspension system arcuate path relative to the vertical axis; and (3) The angle of the user's body relative to the angle of the suspension system. With different weight types attached to the suspension system, the user can provide varied handholds thus giving a comprehensive workout for grip strength and target specific muscles. The attachable weight elements can include but are not limited to kettle bells, dumbbells, weight plates, barbells, medicine balls, center mass balls, etc.

With adjustable height and weight, the present adjustable exercise suspension system with hanging weight provides an effective workout for any fitness level. It provides a wide variety of exercise options with the user standing, sitting, planking, or laying down. It is ideal for elite athletes who can add heavy weights for explosive exercises or muscle specific isolation work. It is also beneficial for the every day exerciser to use with lighter weight to focus on functional training, flexibility, and coordination.

By varying the length of the suspension strap assembly which controls the height of the weight element relative to the user and floor, different muscle groups can be targeted for exercise. For example, adjusting the suspension strap assembly to position the weight element at chest height can target and work the chest, shoulders, jammers, triceps, legs, and core. Positioning the weight element at hip height can target and work the biceps, back, legs, and core. Positioning the weight element at calf height can target and work the planks and core.

The free movement of the exercise suspension system with hanging weight allows users to perform twisting, pressing, pushing, pulling, jamming, balancing, and explosive workouts with a high degree of flexibility and safety. Unlike traditional plate loaded or cable machines, the suspension system with attached weight is less restrictive and allows a more natural free flowing movement. Unlike traditional free weights, the system also provides an extra bit of planar restriction for stability and safety in motion. Advantageously, the exercise suspension system also provides users with a simple and easy way to safely remove the weight from themselves and stop the exercise by simply returning the weight to the vertical position without dropping or slamming the weights to the ground. This enhances the safety of the weight lifting routine. Unlike traditional strap suspension systems, limited by the weight of the user which provides the resistance force for exercise, different size and/or types of weight elements can be readily added and removed to allow for more than just body weight exercises.

In one aspect, a method for exercising using an exercise suspension system with tethered weight comprises: providing a length-adjustable suspension strap assembly attached at one end to a fixed overhead support structure and at an opposite end to a detachable weight element, the suspension strap assembly comprising a plurality of straps detachably connected together, wherein the weight element is suspended from the overhead support structure creating a tensile force in the suspension strap assembly; manually moving the weight element in a first direction from a first position to a second position along a first arcuate path in a first plane of stable motion; and returning the weight element from the second position to the first position; wherein the weight is supported and guided during movement along the first arcuate path by the suspension strap assembly.

In another aspect, a method for exercising using an exercise suspension system with tethered weight comprises: providing a length-adjustable suspension strap assembly attached at one end to a fixed overhead support structure, the suspension strap assembly comprising a plurality of flexible straps including: (i) an elongated adjustable strap sub-assembly comprising: an adjustment strap including a top end terminated with a first carabiner and a lower section slideably threaded through a selectively lockable adjustment side of a cam buckle, and a connector strap having a top end fixedly attached to a fixed side of the cam buckle and a bottom end terminated with a loop; (ii) an extension strap including a first end terminated with a D-ring and a second end terminated with a loop, and wherein a medial portion of the extension strap between the first and second ends is wrapped around the overhead support structure, and the D-ring and loop of the extension strap are each coupled to the first carabiner of the adjustment strap; (iii) a weight strap including a top end terminated with a second carabiner coupled to the connector strap of the adjustable suspension strap assembly and a permanently closed continuous securement loop extending downwards from the top end of the weight strap; and (iv) a weight element suspended from the weight strap and creating a tensile force which forms a taut condition of the suspension strap assembly; manually moving the weight element in a first direction from a first position to a second position along a first arcuate path in a first plane of stable motion; and returning the weight element from the second position to the first position; wherein the weight is supported and guided during movement along the first arcuate path by the suspension strap assembly.

In another aspect, a method for exercising using an exercise suspension system with tethered weight comprises: providing a length-adjustable suspension strap assembly attached at one end to a fixed overhead support structure, the suspension strap assembly comprising a plurality of flexible straps including: (i) an elongated length adjustable strap sub-assembly comprising: an adjustment strap forming a permanently closed continuous loop, the adjustment strap including a top end terminated with a first carabiner and a lower section slideably threaded through a selectively lockable adjustment side of a cam buckle, and a connector strap having a top end fixedly attached to a fixed side of the cam buckle and a bottom end terminated with a loop; (ii) a weight strap including a top end terminated with a second carabiner coupled to the connector strap of the adjustable suspension strap assembly and a permanently closed continuous securement loop extending downwards from the top end of the weight strap; and (iii) a weight element suspended from the weight strap and creating a tensile force which forms a taut condition of the suspension strap assembly; manually moving the weight element in a first direction from a first position to a second position along a first arcuate path in a first plane of stable motion while maintaining the taut condition of the suspension strap assembly; and returning the weight element from the second position to the first position; wherein the weight is supported and guided during movement along the first arcuate path by the suspension strap assembly.

BRIEF DESCRIPTION OF THE DRAWINGS

The features of the exemplary embodiments will be described with reference to the following drawings in which like elements are labeled similarly, and in which.

Figure 1:
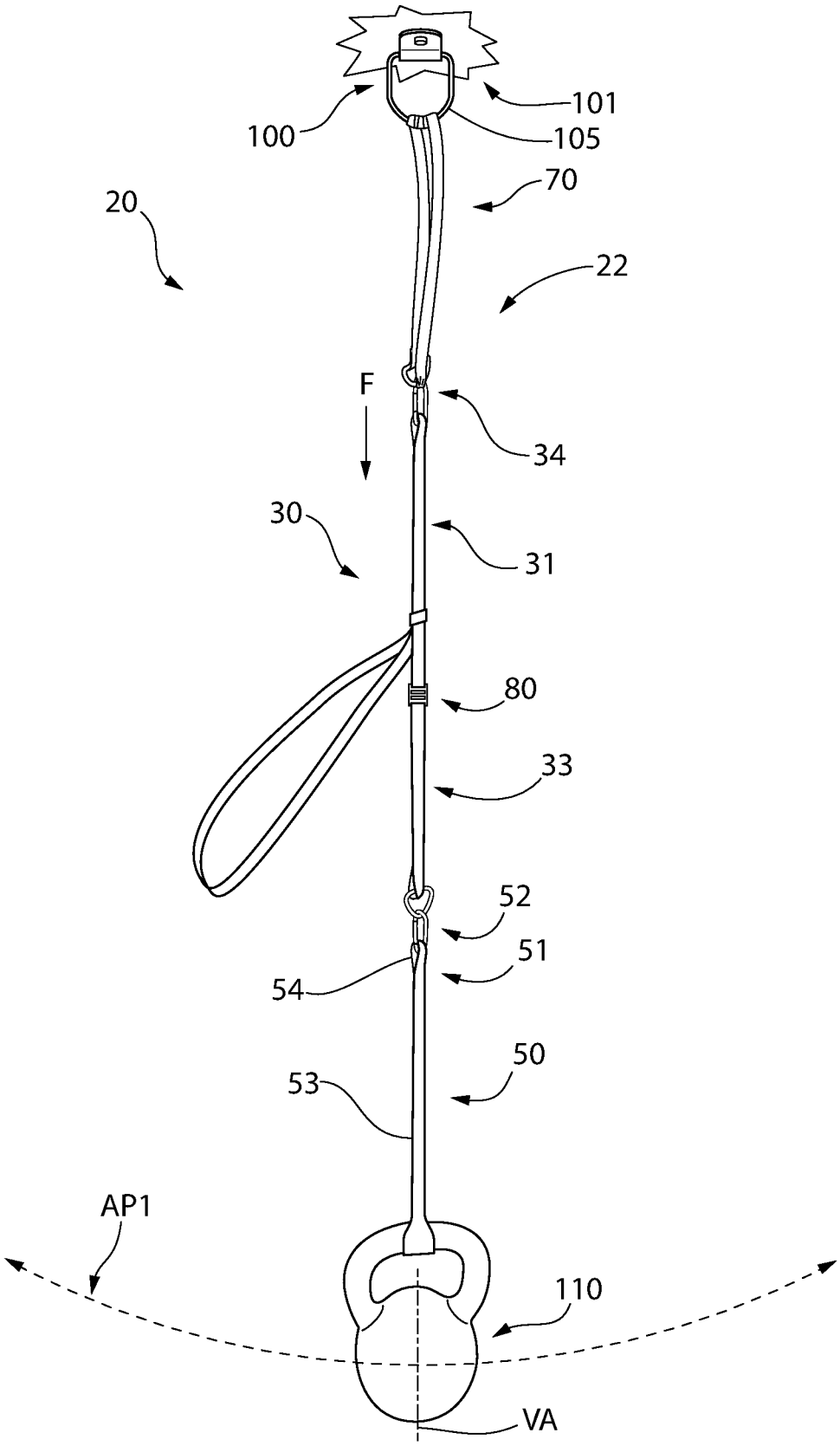
FIG. 1 is a side perspective view of a suspension exercise system with a suspension strap assembly according to an embodiment of the present disclosure mounted to an overhead support structure.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION OF THE INVENTION

The features and benefits of the present disclosure are illustrated and described herein by reference to exemplary ("example") embodiments. This description of exemplary embodiments is intended to be read in connection with the accompanying drawings, which are to be considered part of the entire written description. Accordingly, the present disclosure expressly should not be limited to such embodiments illustrating some possible non-limiting combination of features that may exist alone or in other combinations of features; the scope of the claimed invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "lateral," "longitudinal," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "coupled," "affixed," "connected," "interconnected," and the like refer to a relationship wherein structures are secured or attached to one another either directly or indirectly through intervening structures, as well as both movable or rigid attachments or relationships, unless expressly described otherwise in a more limiting manner.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
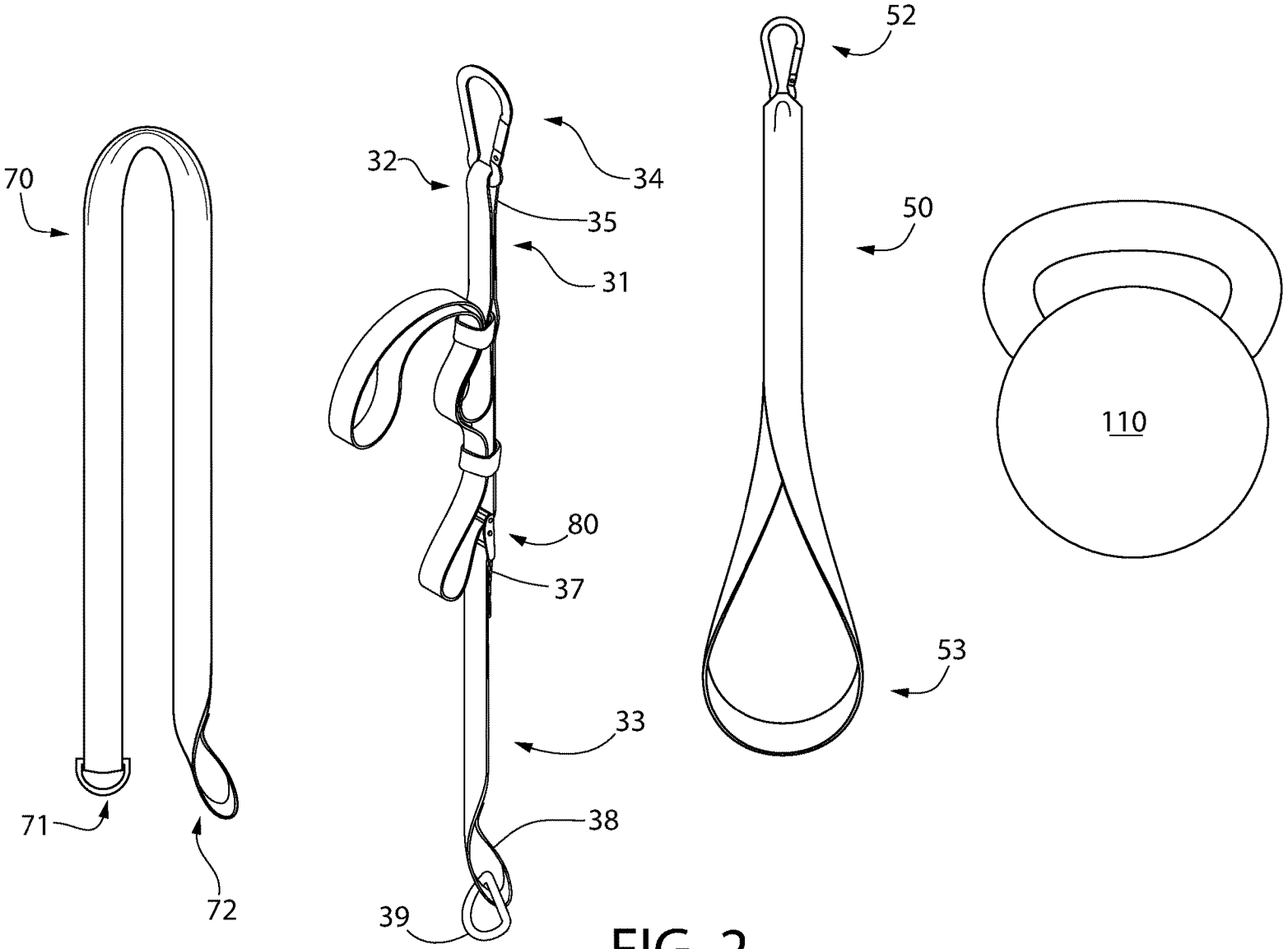
FIG. 2 is an exploded view of the suspension strap assembly thereof.

FIGS. 1-2 show one non-limiting embodiment of a length adjustable exercise suspension system 20 according to the present disclosure. System 20 generally includes a weight element 110 suspended from and tethered to an overhead support structure 100 by a length-adjustable and vertically elongated suspension strap assembly 22. The suspension strap assembly 22 in one embodiment may be formed of a plurality of interconnected and selectively detachable straps, which are further described in detail herein. The straps of suspension strap assembly 22 have a larger width than thickness and length substantially larger than the width. The straps are formed of a substantially inelastic yet flexible/bendable material which lacks a rigid structure and is configurable/conformable in shape. The term "inelastic" in the context of the present disclosure is used to distinguish such "inelastic" strap materials without a defined elastic memory from those of resiliently elastic resistance bands having an elastic memory which act like rubber bands and can be stretched a significant amount in length. In some embodiments, straps of the present exercise suspension system 20 may be made of woven nylon or polyester which has sufficient strength to satisfactorily support the weight element suspended from the straps. It bears noting that such woven straps will stretch to a minimal degree when loaded, but not have or perform like elastomeric or rubber per se which have an elastic memory. In one non-limiting embodiment, the straps may be made of woven polyester for its low stretch rate and abrasion resistance properties. The straps may have a representative width in one representative example without limitation of about 1.5 to 2 inches in one embodiment. Other widths may of course be used.

Figure 13:
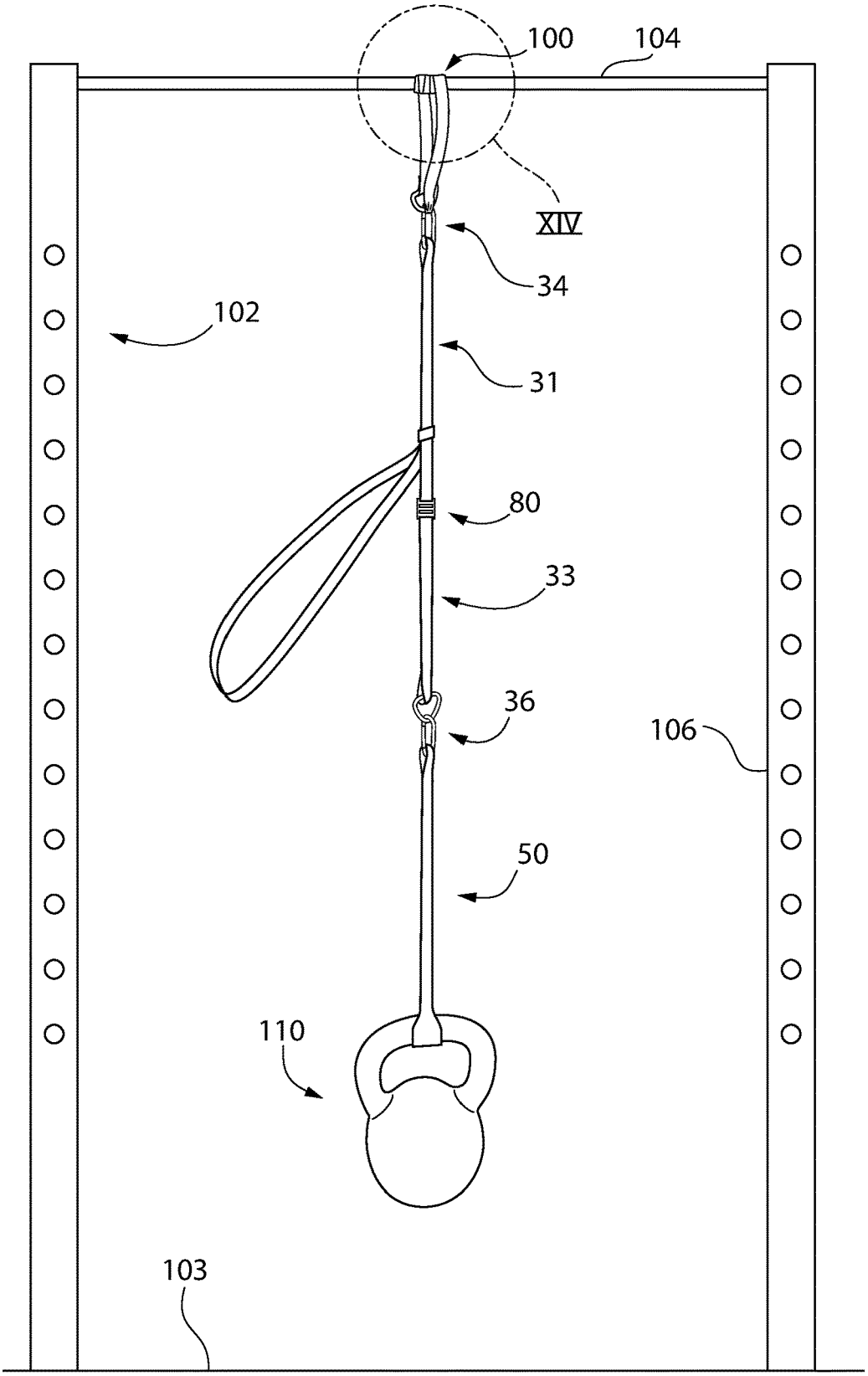
FIG. 13 shows the suspension strap assembly mounted to an alternative embodiment of an overhead support structure in the form of a weight rack; sequence of is a first thereof, front view thereof.
Figure 14:
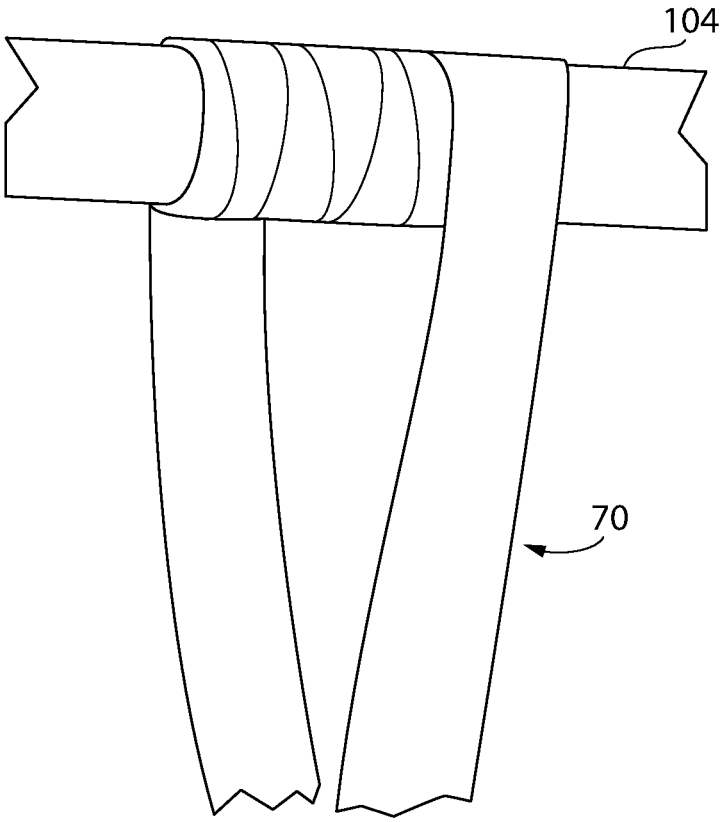
FIG. 14 is a detailed view from FIG. 13.
Figure 15:
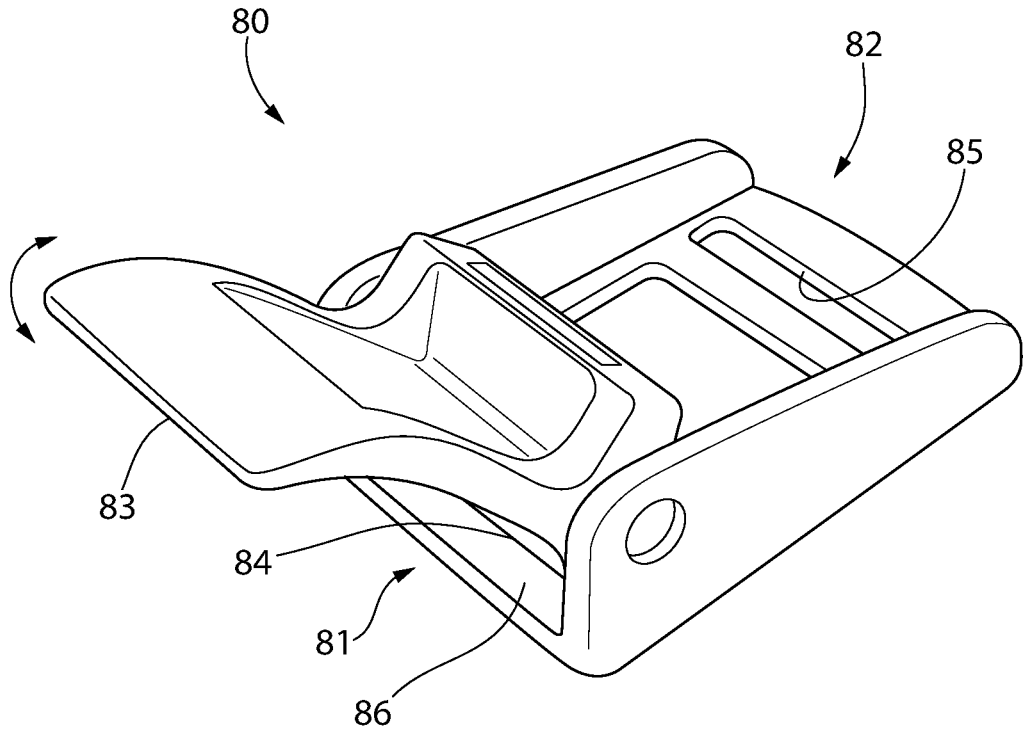
FIG. 15 is a perspective view of the cam buckle of the strap sub-assembly.

The overhead support structure 100 may be any indoor or outdoor structure which can provide sturdy anchorage for mounting the suspension strap assembly 22 thereto in a suspended manner. Examples of support structures 100 include without limitation a flat concrete ceiling to which an anchor 105 may be attached such as via fasteners for coupling the suspension strap assembly 22 thereto (see, e.g. FIG. 1), ceiling joists, bars of exercise or weight lifting racks/equipment, piping, structural steel members (e.g. I-beams), or other types of available overhead structures having sufficient rigidity. FIG. 13 shows an example of a weight rack 102 comprising vertical stanchions 106 which rest on floor 103 and support a horizontal bar 104 therebetween which acts as the overhead support structure 100. The invention is not limited by the type of overhead support structure 100 which may be used as the anchor point for the suspension strap assembly 22 of the present exercise suspension system 20.

With additional reference to FIGS. 3-9, the suspension strap assembly 22 in one embodiment generally includes a length adjustable strap sub-assembly 30 for adjusting the length of the suspension strap assembly 22, a weight strap 50, and optionally an extension strap 70. The adjustable strap sub-assembly 30 in turn includes an adjustable-length adjustment strap 31 and a fixed length connector strap 33. Adjustment strap 31 may be generally include a top end 32 terminated with a first carabiner 34 and a lower section of the strap slideably and selectively lockable in position to a cam buckle 80. The top end 32 of the adjustment strap 31 may include an end loop 35 such as a sewn-in loop (see, e.g. FIGS. 2 and 3) for coupling to the openable/closeable carabiner 34. Carabiners and their operation are well known in the art and commercially available thus requiring no further elaboration for the sake of brevity.

Referring momentarily to FIGS. 4, 5A-B, and 15, cam buckle 80 has a body which defines the adjustment side 81 and an opposite fixed side 82. A spring-biased cam plate 83 is pivotably attached to the body of cam buckle 80 at the adjustment side 81 as shown. Cam plate 83 is configured to selectively and lockingly engage the lower section of the adjustment strap 31 which slideably passes through an elongated slot 84 on the adjustment side 81 which is defined between the cam plate and cross-piece 86. Cam buckle 80 (i.e. cam plate 83) is movable between a depressed unlocked position and a locked position. The cam plate 83 applies a compressive clamping force on adjustment strap 31 in a known manner when in the locked position to prevent relative movement between the strap and the cam buckle 80. Spring 89, which may be a torsion spring in one embodiment, is mounted on the lateral pivot pin of the cam plate 83 and biases the cam buckle into the locked position. The cam plate 83 may include teeth to better grip the adjustment strap 31. To operate the cam buckle 80, the user depresses the cam plate 83 to unlock the cam buckle, which releases the adjustment strap 31 allowing it to be pulled through buckle to adjust the length of the adjustment strap. When the user releases the cam plate 83, the cam buckle automatically grips and locks the adjustment strap 31 in position due to the biasing action of spring 89.

Figure 3:
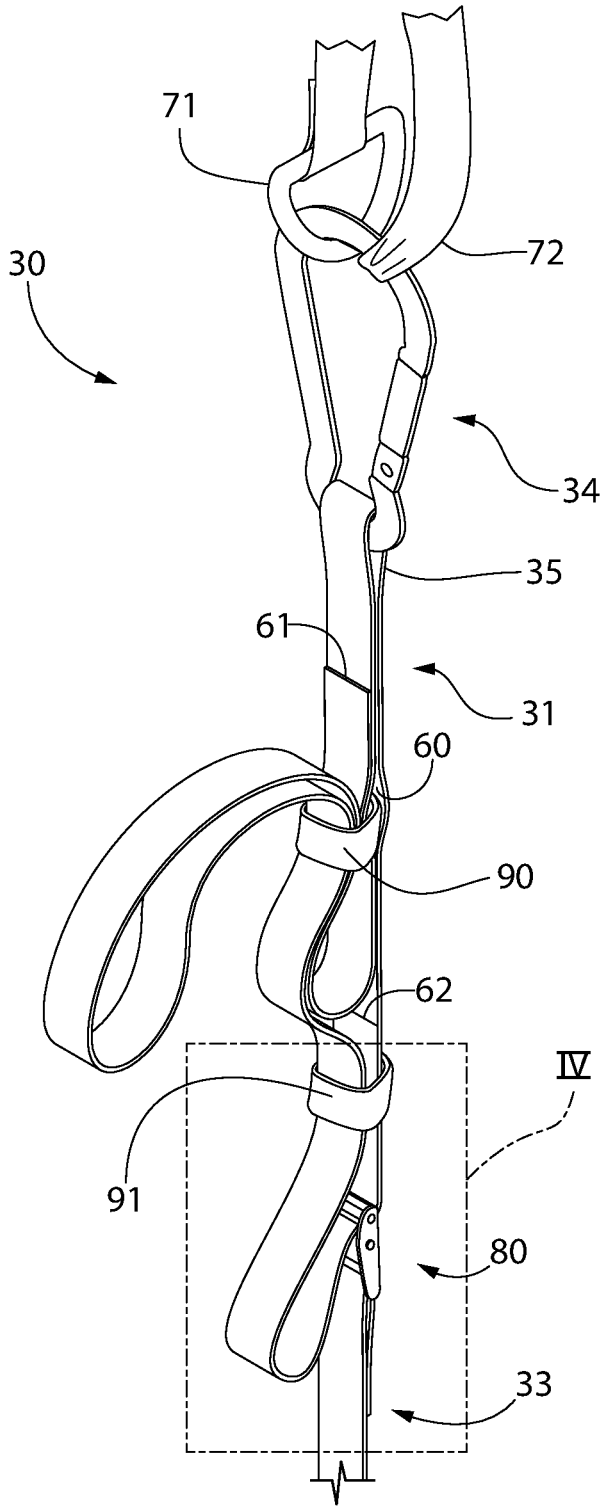
FIG. 3 is a perspective view of the length adjustable strap sub-assembly thereof.
Figure 4:
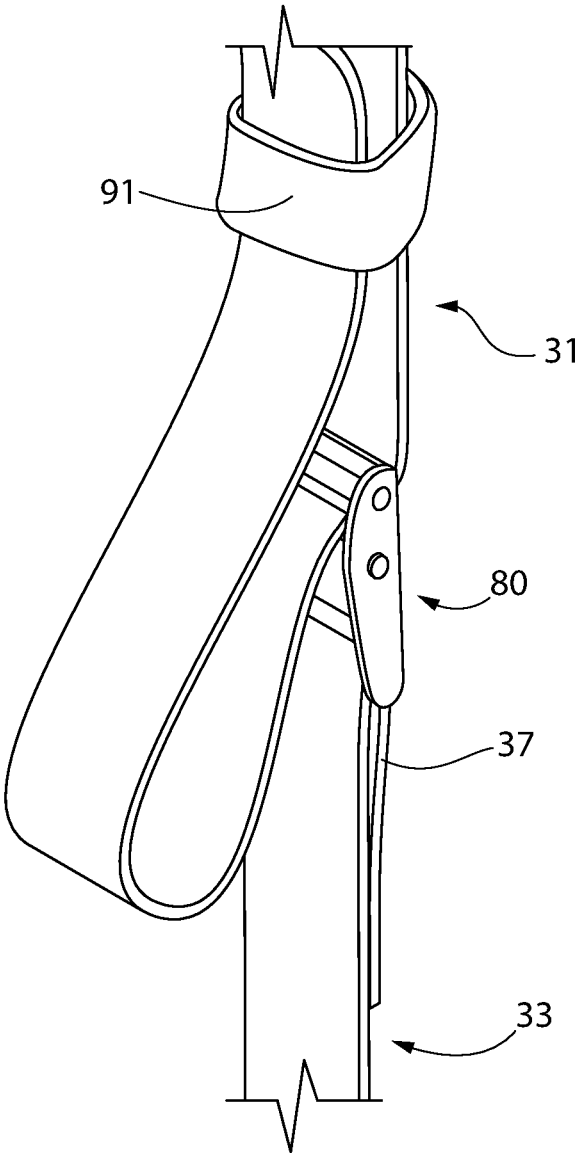
FIG. 4 is a detailed view taken from FIG. 3.
Figure 5A:
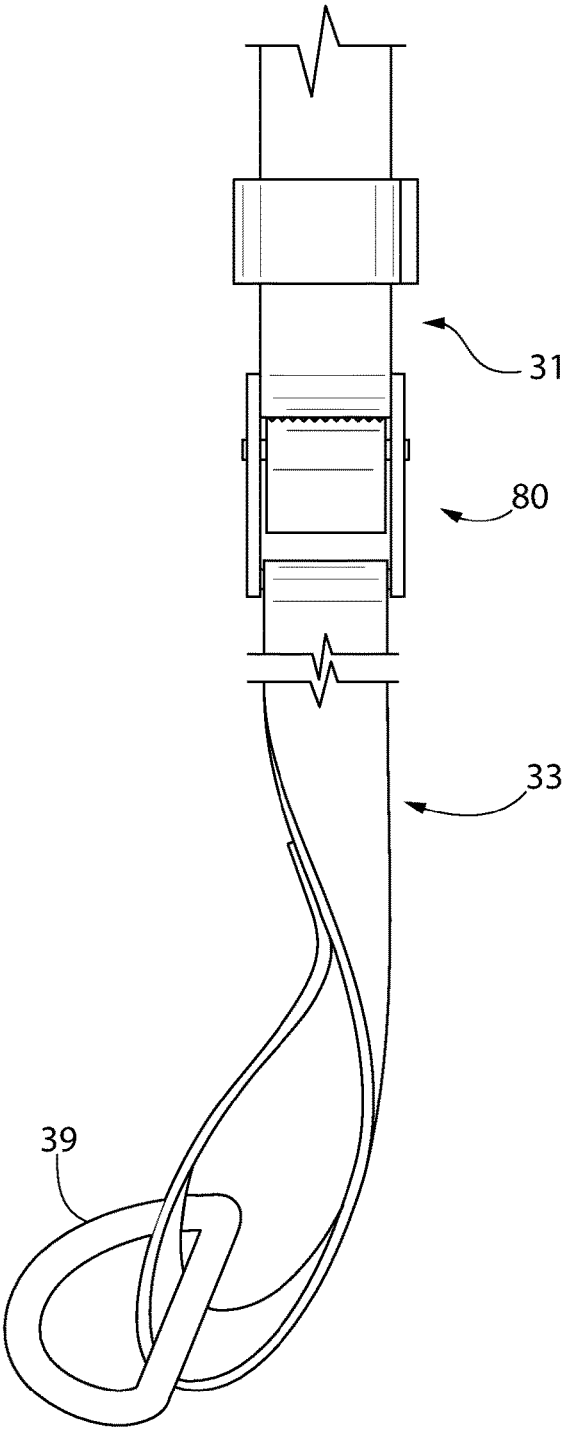
FIG. 5A is a front view of the strap sub-assembly showing the cam buckle.
Figure 5B:
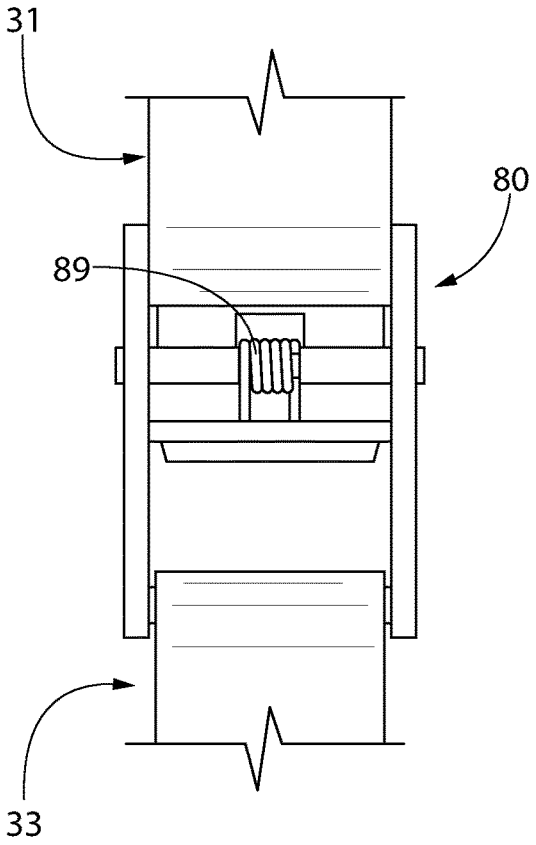
FIG. 5B is a rear view thereof.
Figure 6:
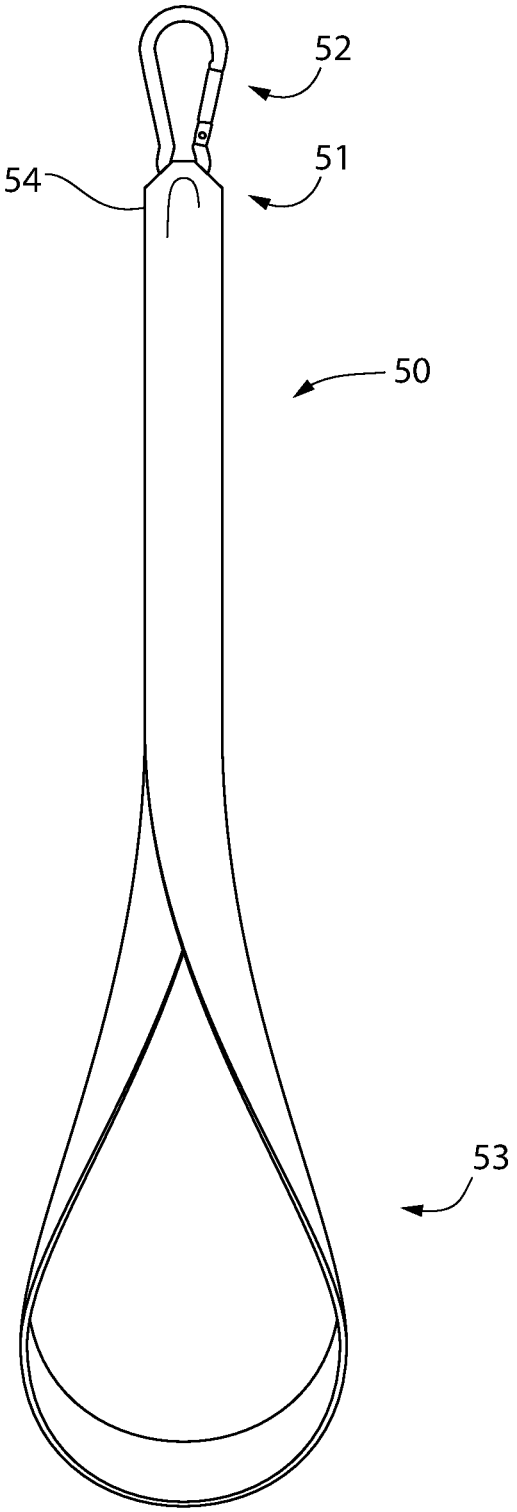
FIG. 6 is a perspective view of the weight strap of the suspension exercise system.

Referring back now to FIGS. 2-9, adjustment strap 31 in one embodiment includes a fixed end 62 secured back onto the strap itself (such as via sewn stitching) and a free end 61. One or more sewn-in intermediate loops 60 (only one of which is shown in FIG. 3 for clarity of illustration) may be provided in the upper portion of the adjustment strap 31 for various purposes. The intermediate loops 60 provide a securement point for attaching the carabiner 34 back onto the strap 31 after wrapping the strap over the overhead support structure 100. This provides an alternative mounting option for the suspension strap assembly rather than directly attaching the carabiner 34 to the support structure 100 or using the extension strap 70. After forming the top end loop 35 of the adjustment strap 31, the intermediate loops 60 are formed by extending the strap downwards for a length, sewing a rear part of the strap to a front part in several places to form the intermediate loops, and finally stitching the end 62 of the strap to the strap to form the fixed end of the strap. The free end 61 of the adjustment strap 31 remains for threading through the cam buckle 80 to selectively adjust the length of the adjustment strap.

In one alternative embodiment, adjustment strap 31 may be configured to form a closed continuous loop of adjustment strap 31 by sewing the free end 61 of the strap onto a portion of the strap itself so that there are no free ends remaining. This eliminates any loose hanging tails of the strap 31.

The fixed side 82 of the cam buckle 80 defines a slot 85 for attaching the fixed length connector strap 33. Connector strap 33 has a top end threaded through slot 85 and is permanently attached to the cam buckle 80 via a sewn-in loop 37. The opposite bottom end of connector strap 33 also includes a sewn-in loop 38. In one embodiment, loop 38 captures a D-ring 39 for attaching the weight strap 50. In other embodiments, the weight strap 50 may be attached directly to loop 38 without a D-ring. Connector strap 33 has a length substantially less than adjustment strap 31 in one embodiment.

In some embodiments, a one or multiple fixed ring loops 90 and slideable ring loops 91 may optionally be provided for organizing and gathering excess length of adjustment strap 31 after the length of the adjustment strap is adjusted by the user (see, e.g. FIGS. 2-5B). The fixed ring loops 90 may be vertically spaced apart and coupled to the intermediate loops 60 of the adjustment strap 31 at different points which fixes the loops 90 in position relative to the adjustment strap. The slideable ring loop 91 encircles both front and rear parts of the adjustment strap 31 and is movable up and down along the strap to a desired position. The illustrated embodiment shows a single fixed ring loop 90 and a single slideable ring loop 91 for simplicity recognizing that additional loops may be provided of each type. In use to secure excess length of the adjustment strap 31, the free end 61 of the adjustment strap 31 is threaded through the slideable ring loop 91 and one or more of the fixed ring loops 90 to minimize any loose tails of strap.

Referring to FIGS. 1-2, the optional extension strap 70 provides additional length when needed for anchoring the exercise suspension system 20 to the overhead support structure 100 and/or an alternative method of attaching the length adjustable strap sub-assembly 30 rather than using carabiner 34 of assembly 30 (see, e.g. FIG. 1 or 13). Extension strap 70 may include a first end terminated with a D-ring 71 and a second end terminated with a sewn-in loop 72. A medial portion of the extension strap 70 between the first and second ends is wrapped around the overhead support structure as shown, and the D-ring 71 and sewn-in loop 72 of the extension strap are each coupled to the first carabiner 34 of the adjustment strap 31. The extension strap 70 may be wrapped once or several times around the overhead support structure 100.

Referring initially to FIGS. 1, 2, and 7-12, weight strap 50 including a top end 51 terminated with a second carabiner 52 and a permanently closed continuous securement loop 53 extending downwards from the top end of the weight strap. Carabiner 52 may be attached to weight strap 50 via a sewn-in loop 54. The carabiner 52 is detachably coupled to the D-ring 39 of connector strap 33 of the adjustable suspension strap assembly at the bottom end of the connector strap. The weight element 110 is coupled to and suspended from the weight strap 50 creating a tensile force in the entire suspension strap assembly 22, thereby forming a taut suspension strap assembly when freely hanging from the overhead support structure 100.

Figure 7:
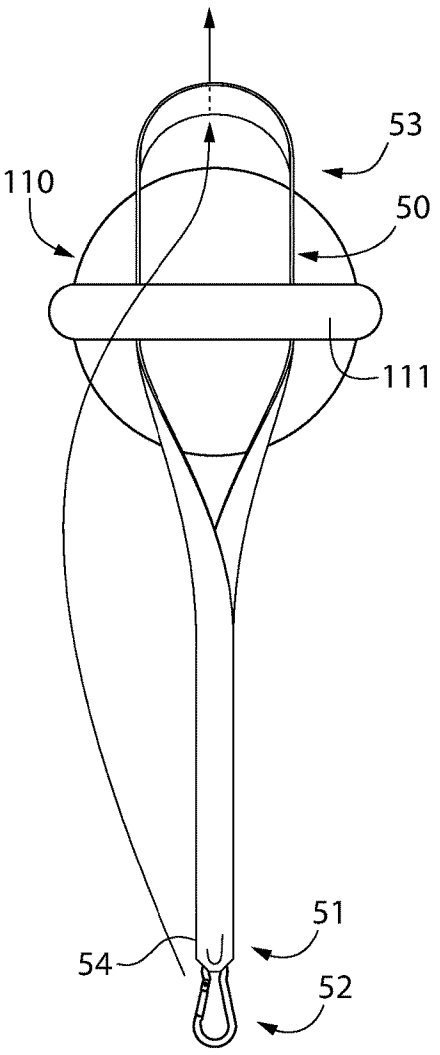
FIGS. 7-9 are sequential views showing a method for mounting the weight element to the weight strap.
Figure 8:
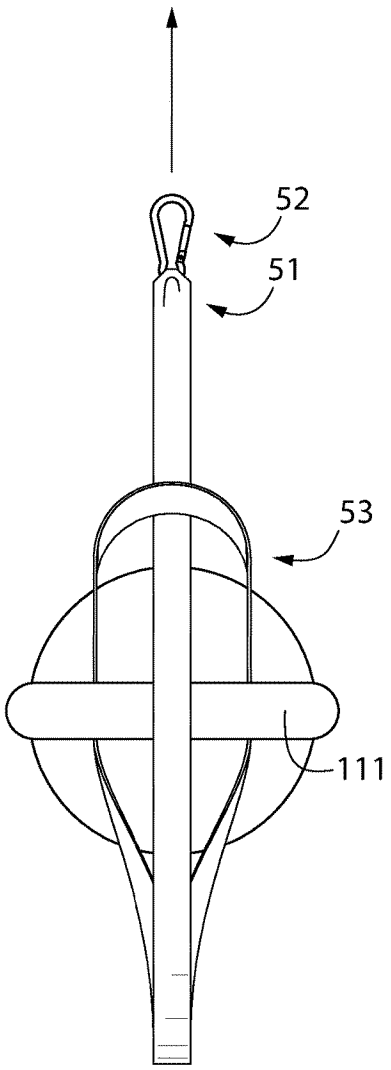
Figure 9:
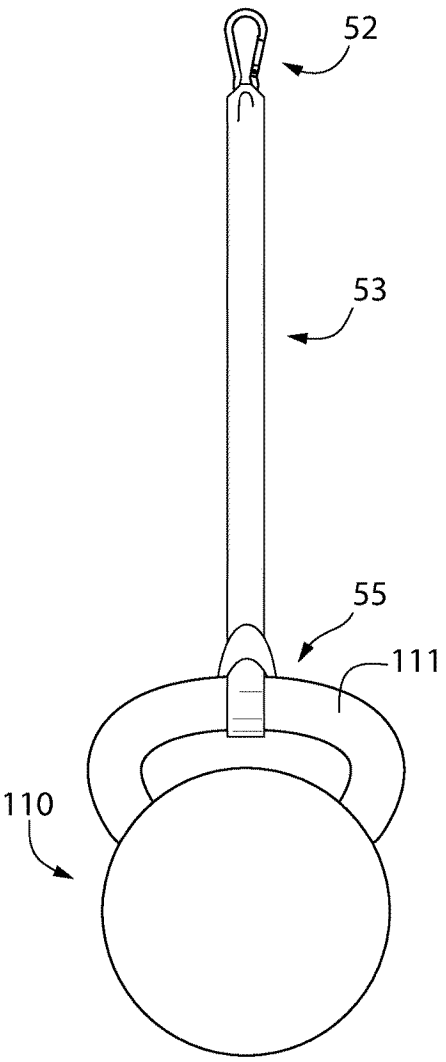

FIGS. 7-9 shown one non-limiting method for attaching the weight element 110 to the weight strap 50. In this example, the weight element 110 may be a kettle bell having a handle 111 forming a straight or arcuately curved bar or rod for attaching the weight strap. The securement loop 53 of weight strap 50 may first be partially inserted beneath the handle 111 and through the handle opening 112 (FIG. 7). Next, the carabiner 52 at the top end 51 of weight strap 50 is passed over top of the handle 111 (instead of through handle opening 112) and inserted downwards through securement loop 53 (FIG. 8). The top end 51 portion of weight strap 50 is then pulled tight which forms a slip knot 55 in the weight strap at the handle 111 of the kettlebell. The carabiner 52 may then be detachably coupled to the connector strap 33.

Figure 12:
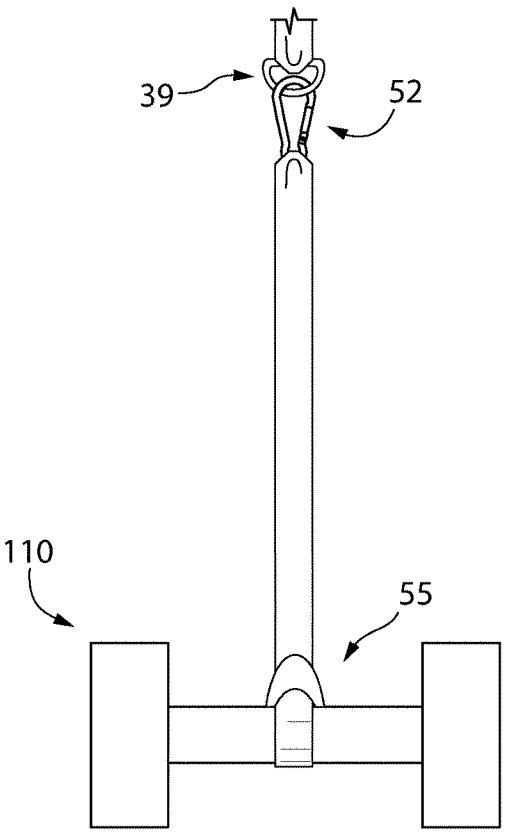
FIG. 12 shows the weight strap attached to one embodiment of a weight element in the form of a dumbbell.
Figure 11:
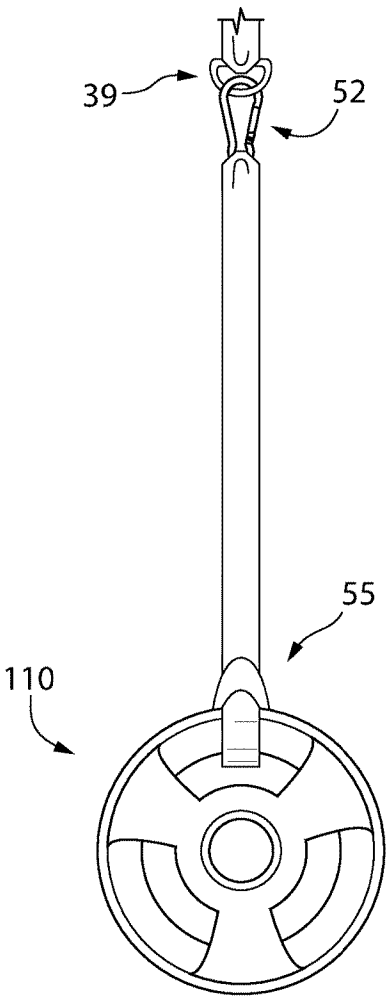
FIG. 11 shows the weight strap attached to another embodiment of a weight element in the form of a weight plate.
Figure 10:
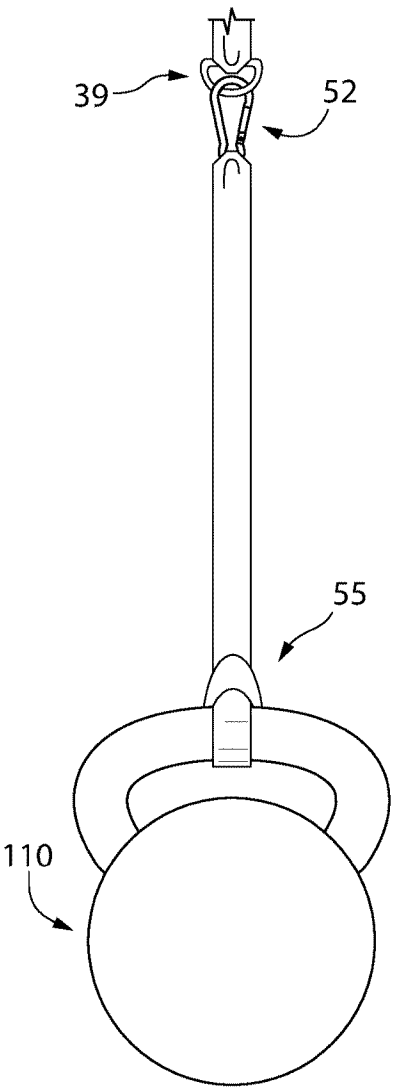
FIG. 10 shows the weight strap attached to one embodiment of a weight element in the form of a kettlebell.

The weight element 110 may have numerous configurations such as shown in FIGS. 10-12 so long as there is an available surface for wrapping the weight strap 50 around in the manner previously described to form the knot 55. Besides the kettlebell shown in FIG. 10, other non-limiting examples of a common weight element 110 found in gyms includes a weight plate as shown in FIG. 11 or a dumbbell as shown in FIG. 12. In these latter two examples, there is a surface defined by a bar or rod of the weight element 110 for attaching the weight strap 50. It will be appreciated that numerous other types of objects may be used as a weight element 110 besides those shown which are associated with weight lifting equipment for convenience. The weight element 110 preferably has a minimum weight sufficient to effectively work the targeted muscle group. In some non-limiting embodiments, for example, weight element 110 may have a minimum weight of 2.5 pounds and more often greater as typically used in weight lifting routines.

The suspension strap assembly 22 of the present exercise suspension system 20 may be assembled in accordance with the following method in one embodiment. Other variations in the following steps and sequence, however, may be used. In one scenario, the carabiner 34 of the adjustment strap 31 of the adjustable strap sub-assembly 30 may be directly attached to the overhead support structure 100 if amenable in configuration for direct coupling to the carabiner (i.e. no intermediate elements) and where the added length of the extension strap 70 might not be needed. FIG. 1 shows an example of an anchor 105 having a ring to which carabiner 34 might be directly attached; however, other objects may be used for direct attachment. In other scenarios, the extension strap 70 is used for the anchorage. In these scenarios, the sewn-in loop 72 at one end of extension strap 70 is passed through the ring of the anchor 105 seen in FIG. 5 and optionally wrapped or wound at least once or more times around ring. The loop 72 and D-ring 71 on the remaining end of extension strap 70 are then both coupled to the carabiner 34 at the top of the adjustment strap 31. The weight strap 50, previously secured to the weight element 110 in the manner described above, may next be attached to the adjustable strap sub-assembly 30. This may be done by coupling the weight strap carabiner 52 to the D-ring 39 of the connector strap 33 of the adjustable strap sub-assembly 30. This completes the physical assembly of the suspension strap assembly 22 with all components shown separately in FIG. 2 now assembled as shown in FIG. 1.

The height at which the weight element 110 is positioned above the floor 103 may next be adjusted using the cam buckle 80 of the adjustment strap 31. Assuming the cam buckle 80 was previously in the locked position prior to assembling the straps in the manner described above, the cam plate 83 of the buckle is first pivoted and unlocked to allow the adjustment strap 31 to slide through the adjustment side 81 of the cam buckle. To shorten the adjustment strap 31, the cam buckle may be pulled or pushed upward along the adjustment strap to achieve the desired length of the strap and height of the weight element 110. The cam plate 83 is then pivoted and re-locked to secure the adjustment strap 31 and weight element in position. To lengthen the adjustment strap 31, the foregoing process is reversed in which the cam buckle 80 is unlocked, pulled downward instead along the adjustment strap to the desired position, and re-locked. A continuum of possible adjustment strap 31 lengths and mounting heights of weight element 110 is obtainable in the foregoing manner.

Figure 26A:
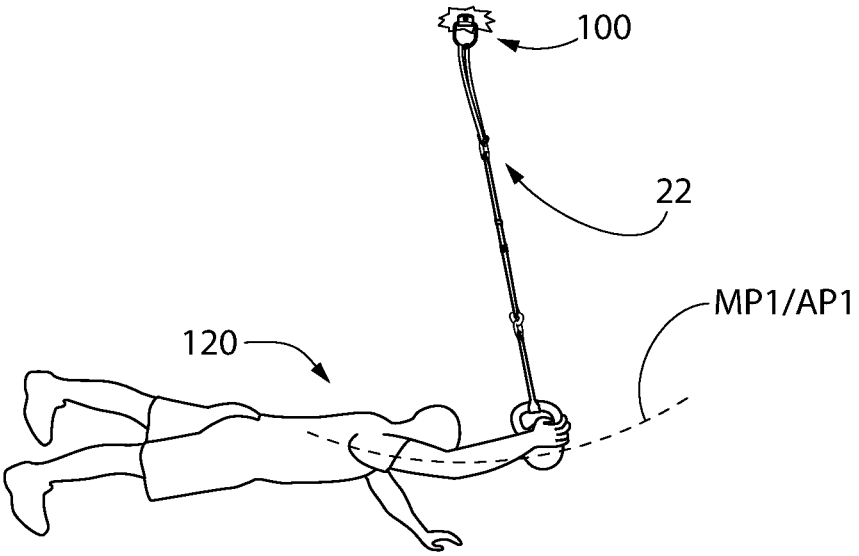
FIGS. 26A and 26B are sequential views showing a user performing a Single Arm Plank Tuck by moving the weight element tethered to the suspension strap assembly along a guided arcuate path from a first starting position to a second exercise position, respectively.
Figure 26B:
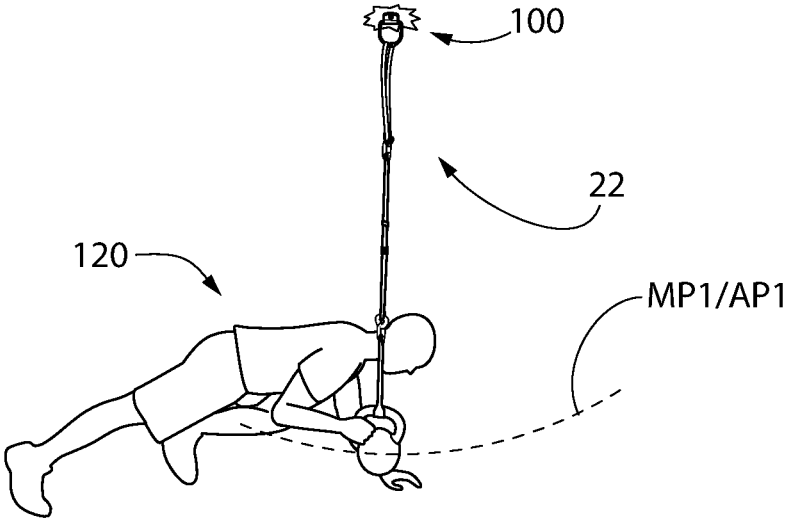
Figure 27:
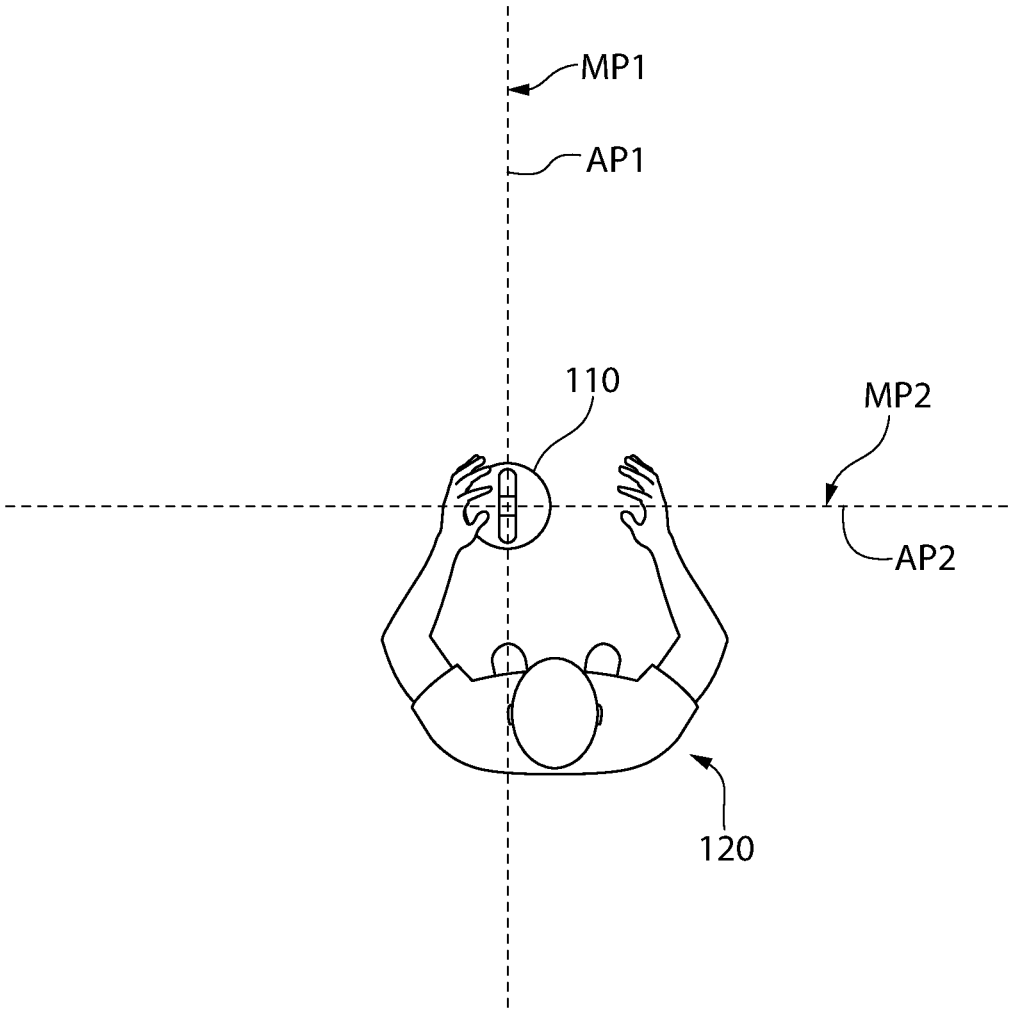
FIG. 27 is a top view looking down on the user and weight element illustrating examples of different arcuate paths and associated planes of stable motion (suspension strap assembly not shown for clarity).

FIG. 1 shows the length and height-adjusted exercise suspension system 20 ready for use. The tethered weight element 110 is suspended from the overhead support structure creating a tensile force F in the suspension strap assembly 22 which assumes a substantially linear configuration and a taut condition. The suspended weight element 110 is manually movable by a user 120 with a pendulum-like motion created by the suspension strap assembly 22 which remains taut due to action of the tensile force F. When not grasped and moved by a user, the freely hanging suspension strap assembly 22 has a vertical orientation which defines a vertical axis VA for reference. The tethered weight is manually movable by the user 120 along a plurality of possible arcuate paths in a plurality of different planes of motion providing a variety of possible exercises which may be performed from a standing, kneeling, sitting, or other position with the feet planted on the ground for stability (see, e.g. FIGS. 16A-25B). For example, FIGS. 1 and 26 show one possible first arcuate path AP1 and associated first plane of stable motion MP1 followed by weight element 110 during an exercise routine via suspension strap assembly 22 which may be in a forward direction relative to the user. The weight element 110 is guided along the arcuate path AP1 by the suspension strap assembly 22 which advantageously provides controlled and stable motion during the exercise. This is particularly beneficial for inexperienced or older users who may require a little assistance to stabilize the weight element 110. This starkly contrasts to "free" weight lifting using dumbbells or barbells in which the user must entirely balance and handle the weight alone without any guidance, thereby increasing the risk of injury. The guided motion of weight element 110 provided by suspension strap assembly 22 promotes good weight lifting technique and functional movement.

FIG. 26 also shows another possible second arcuate path AP2 and associated second plane of stable motion MP2 which can be followed by weight element 110 which may be in a lateral direction relative to the user 120. A variety of arcuate paths and planes of motion between AP1-MP1 and AP2-MP2 are possible. It bears noting that each position of weight element 110 along the arcuate path creates a different angle relative to the vertical axis VA defined by the suspension strap assembly 22.

Figure 16A:
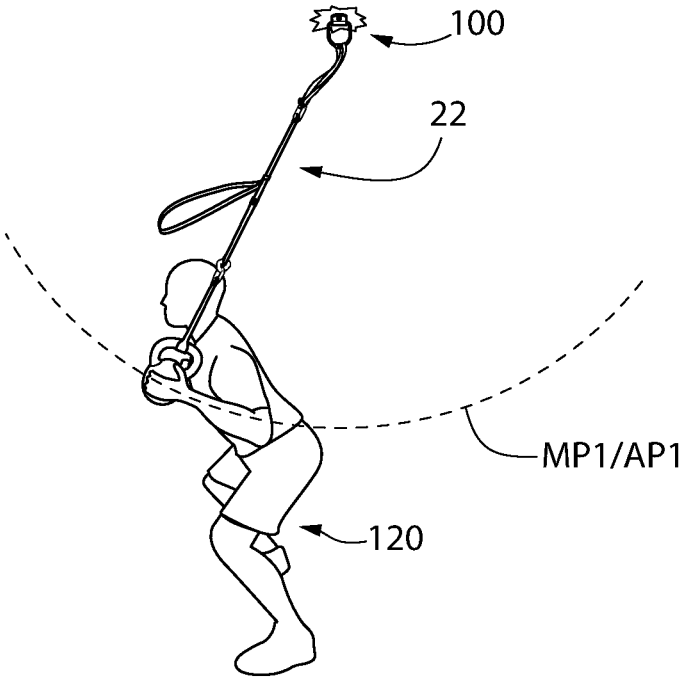
FIGS. 16A and 16B are sequential views showing a user performing a standing chest press with squat stance by moving the weight element tethered to the suspension strap assembly along a guided arcuate path from a first starting position to a second exercise position, respectively.
Figure 16B:
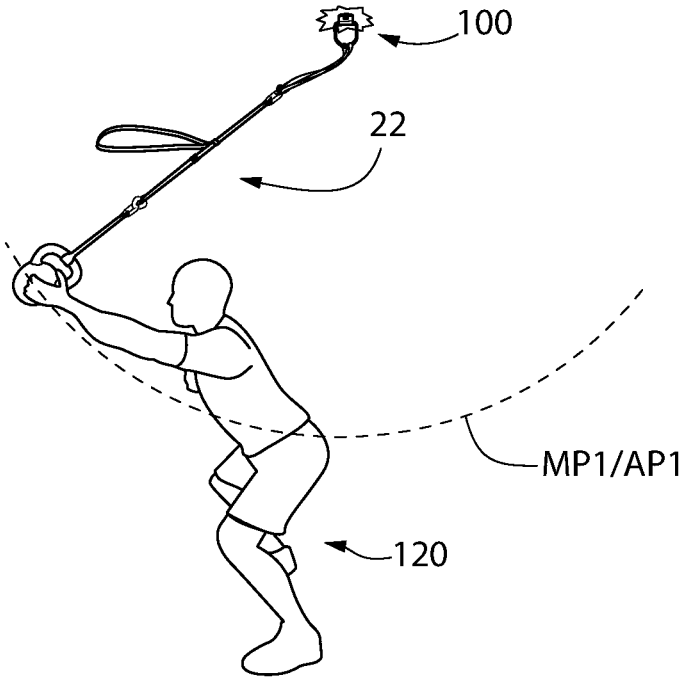
Figure 17A:
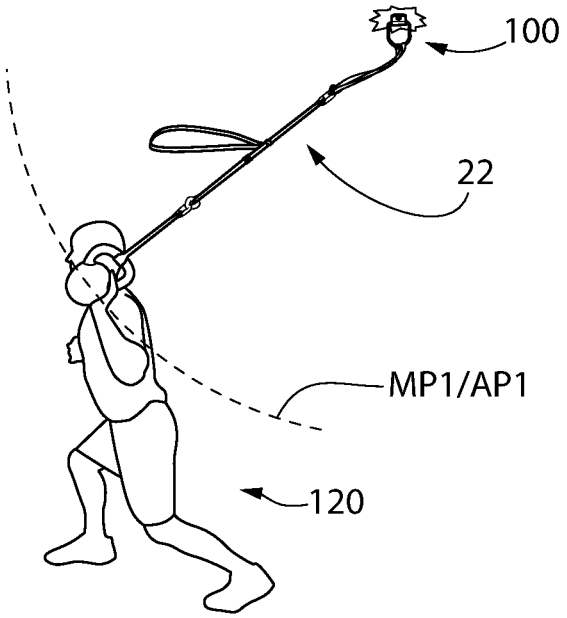
FIGS. 17A and 17B are sequential views showing a user performing a standing shoulder press with split stance by moving the weight element tethered to the suspension strap assembly along a guided arcuate path from a first starting position to a second exercise position, respectively.
Figure 17B:
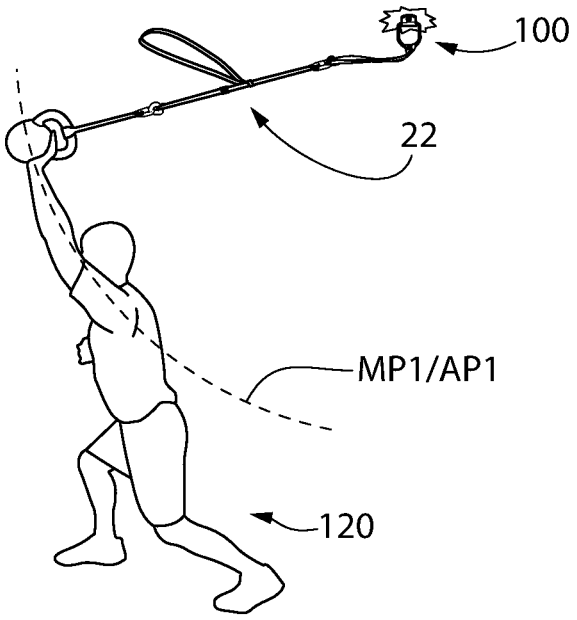
Figure 18A:
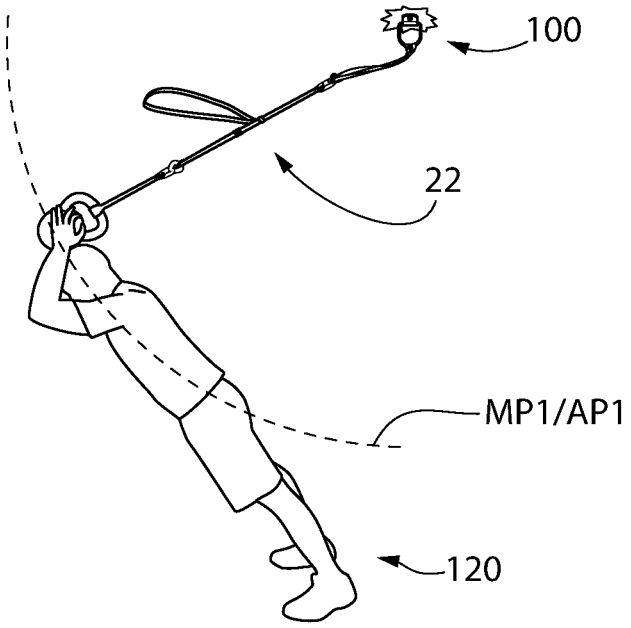
FIGS. 18A and 18B are sequential views showing a user performing a Standing Overhead Triceps Extension by moving the weight element tethered to the suspension strap assembly along a guided arcuate path from a first starting position to a second exercise position, respectively.
Figure 18B:
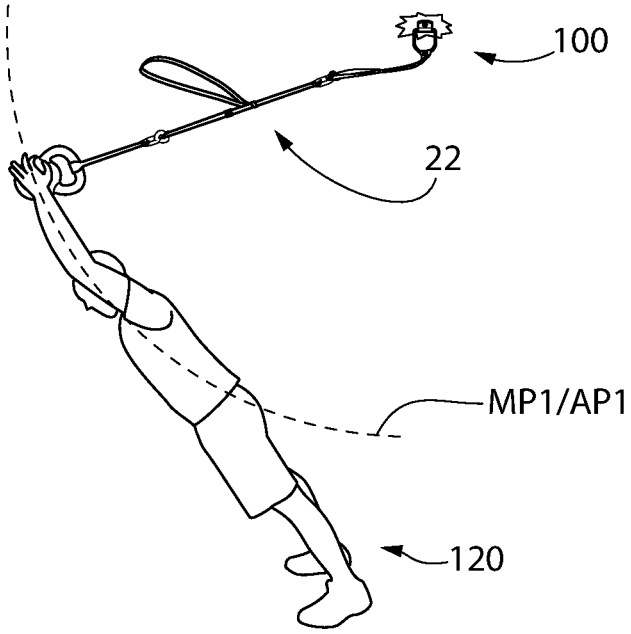

When the weight element 110 is in an angular position relative to vertical axis VA, it bears noting that the tensile force F in suspension strap assembly 22 decreases the farther the position of the weight deviates from axis VA representing a free hanging position of the weight. This is attributable to the fact that the user is providing some support for the weight element 110 as it moves away from vertical. The tensile force F is at a maximum in FIG. 1 when the suspension strap assembly 22 is in the vertical position aligned with vertical axis VA without the user pushing or pulling the weight element 110. In FIGS. 16A-B, the tensile force F is less in FIG. 16A as the weight element moves away from vertical axis VA, and still less in FIG. 16B in which the weight element is farther from the vertical axis.

Figure 19A:
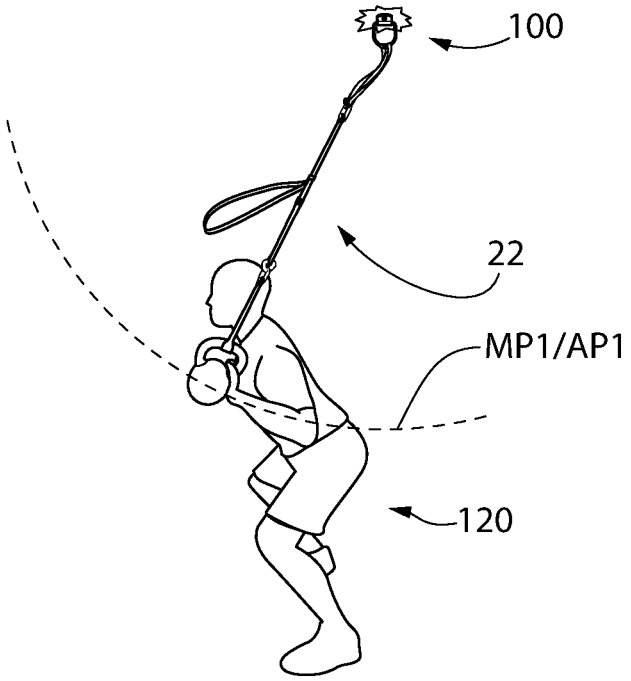
FIGS. 19A and 19B are sequential views showing a user performing a Squat with Single Arm Toss by moving the weight element tethered to the suspension strap assembly along a guided arcuate path from a first starting position to a second exercise position, respectively.
Figure 19B:
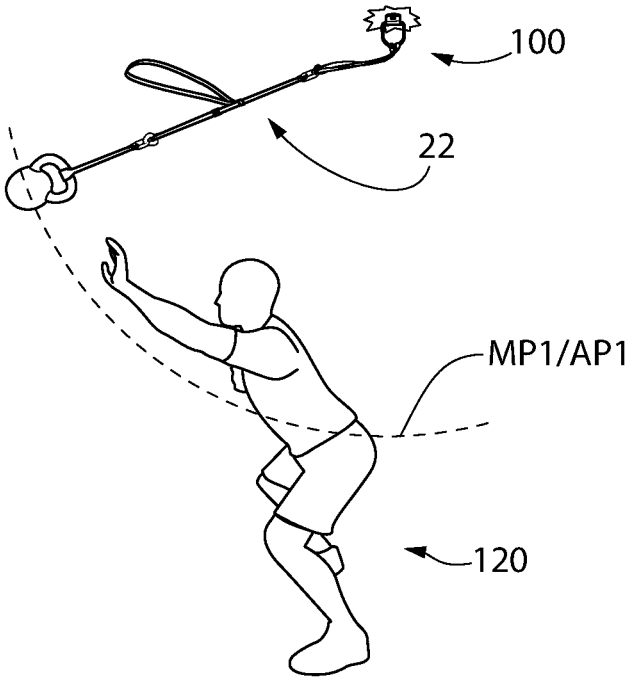
Figure 20A:
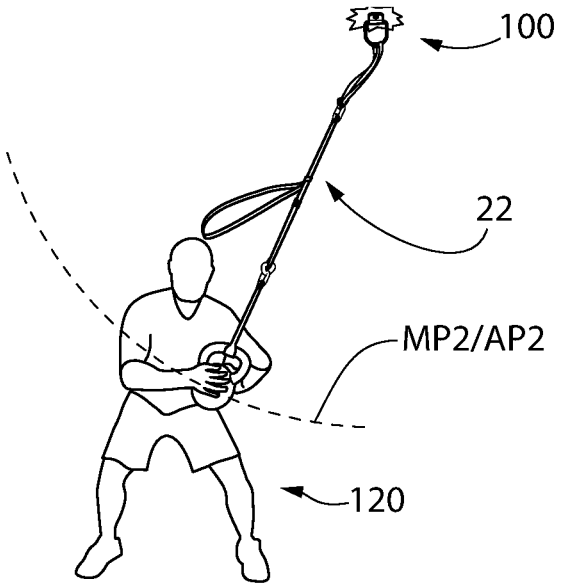
FIGS. 20A and 20B are sequential views showing a user performing a Two Arm Twist and Press by moving the weight element tethered to the suspension strap assembly along a guided arcuate path from a first starting position to a second exercise position, respectively.
Figure 20B:
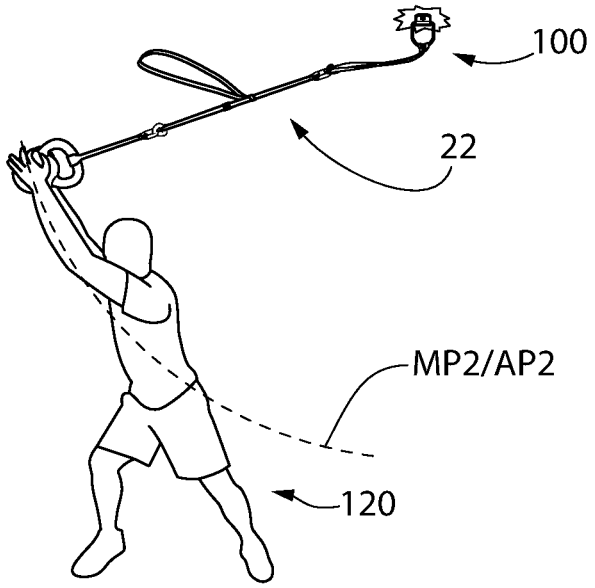
Figure 21A:
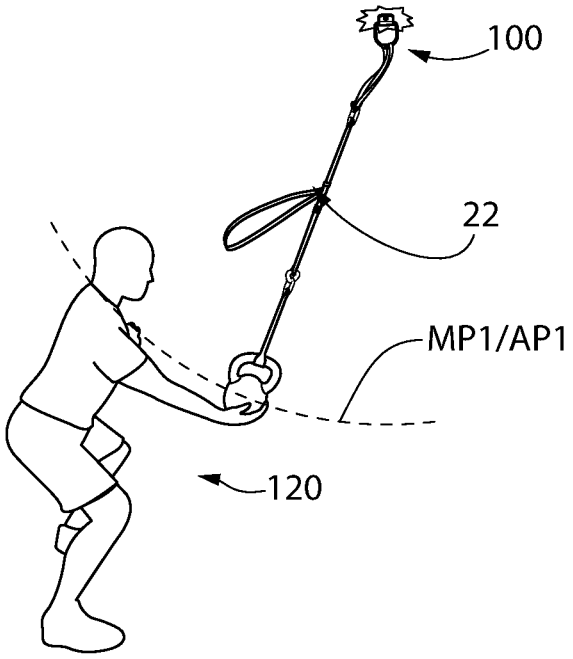
FIGS. 21A and 21B are sequential views showing a user performing a Single Arm Curl by moving the weight element tethered to the suspension strap assembly along a guided arcuate path from a first starting position to a second exercise position, respectively.
Figure 21B:
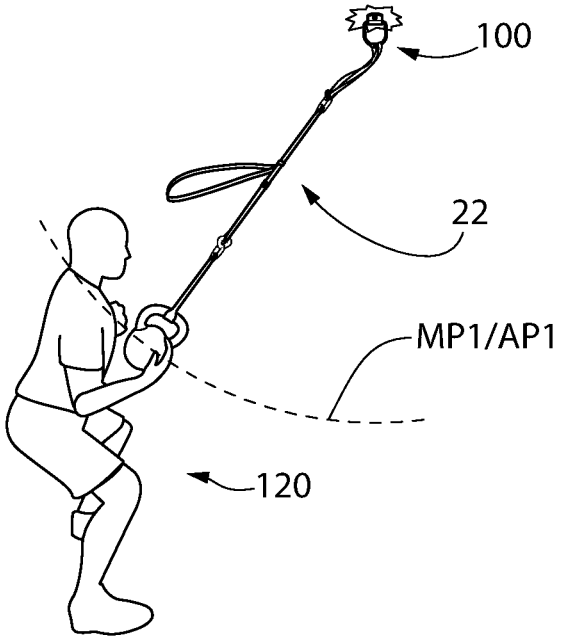
Figure 22A:
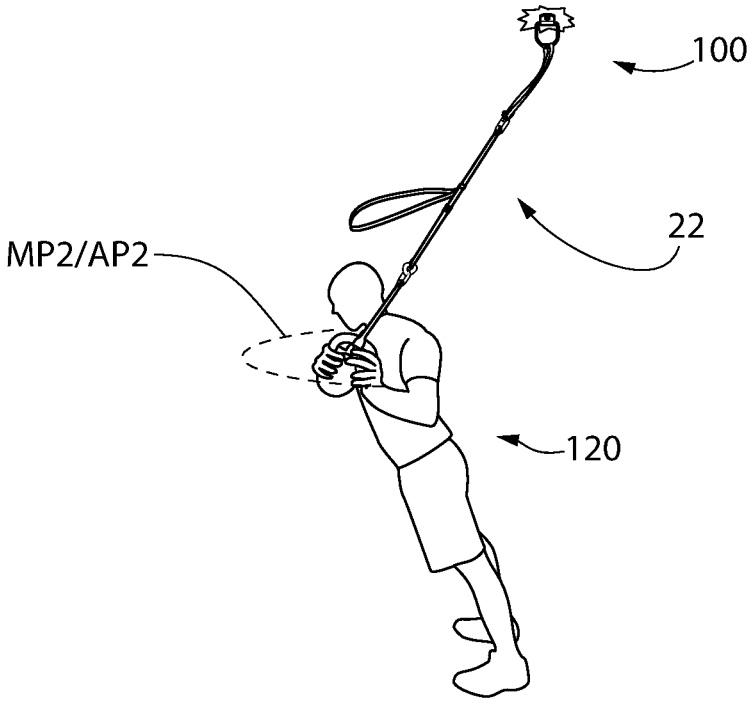
FIGS. 22A and 22B are sequential views showing a user performing a Standing Russian Twist by moving the weight element tethered to the suspension strap assembly along a guided arcuate path from a first starting position to a second exercise position, respectively.
Figure 22B:
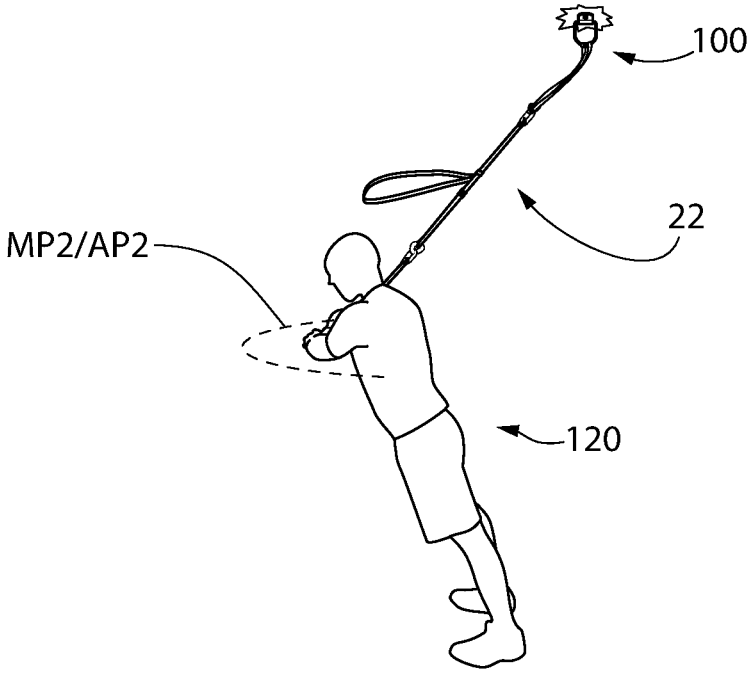
Figure 23A:
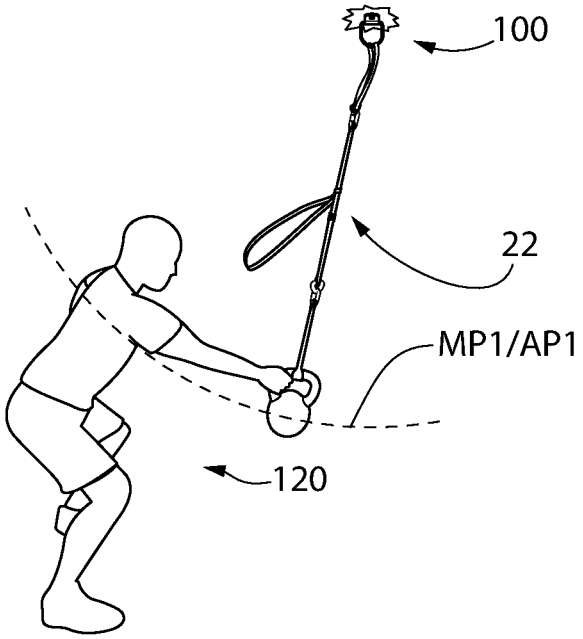
FIGS. 23A and 23B are sequential views showing a user performing a Single Arm Row by moving the weight element tethered to the suspension strap assembly along a guided arcuate path from a first starting position to a second exercise position, respectively.
Figure 23B:
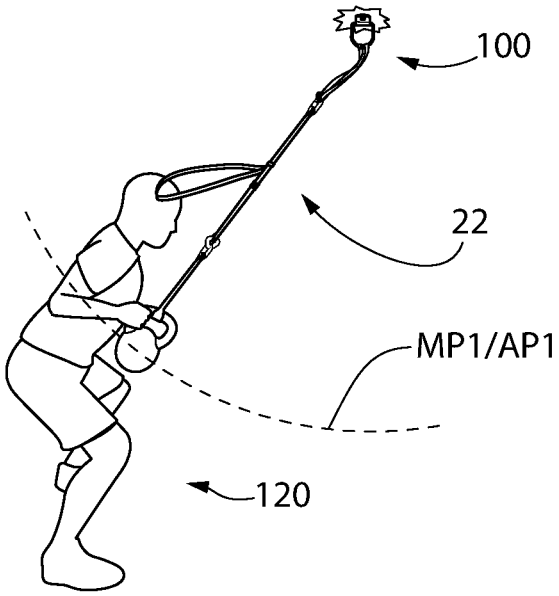
Figure 24A:
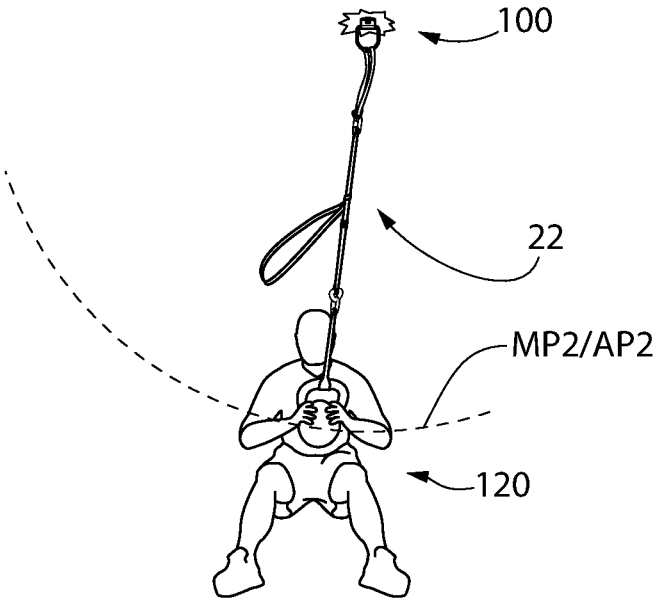
FIGS. 24A and 24B are sequential views showing a user performing a Seated Side Toss by moving the weight element tethered to the suspension strap assembly along a guided arcuate path from a first starting position to a second exercise position, respectively.
Figure 24B:
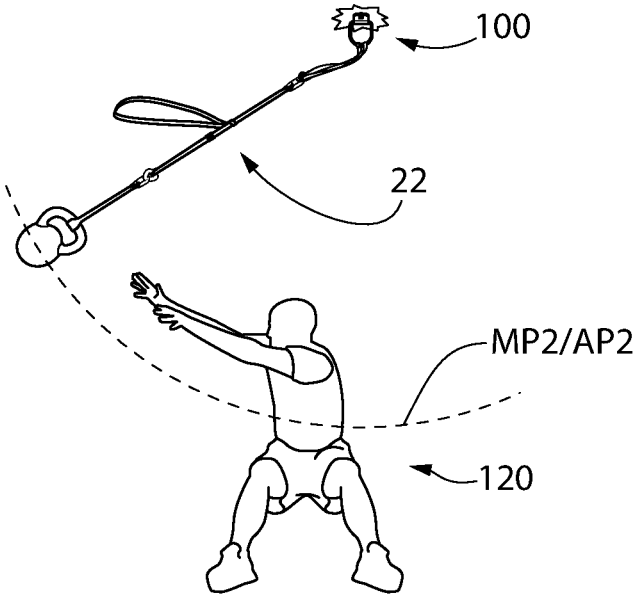
Figure 25A:
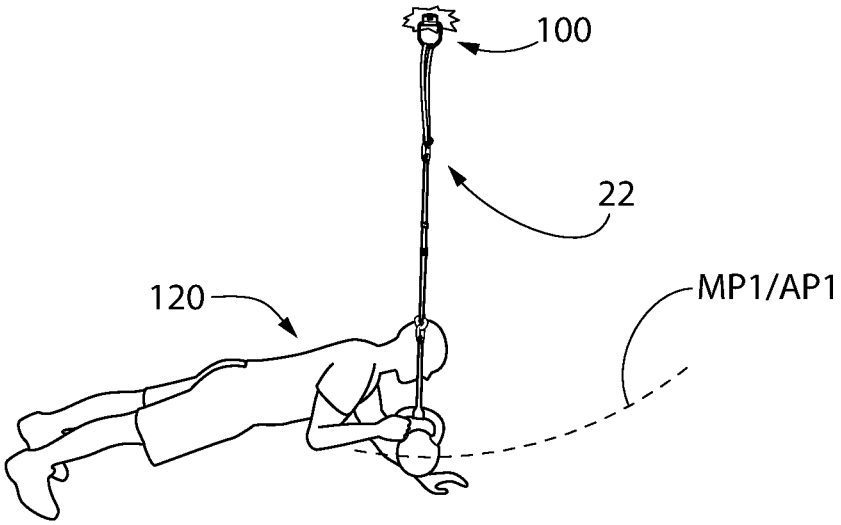
FIGS. 25A and 25B are sequential views showing a user performing a Single Arm Plank Extension by moving the weight element tethered to the suspension strap assembly along a guided arcuate path from a first starting position to a second exercise position, respectively.
Figure 25B:
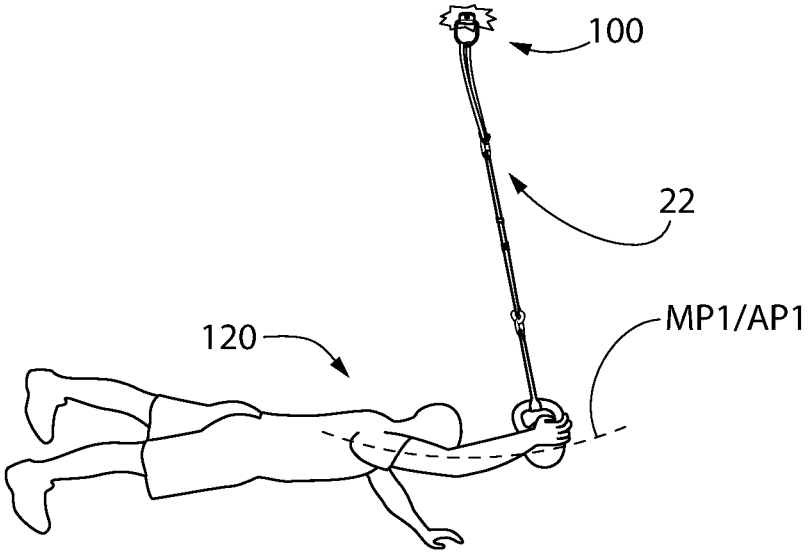

Each pair of views shown in FIGS. 16A-25B represent some non-limiting examples of numerous possible exercises which may be performed by a user 120 with the present exercise suspension system 20. In various exercise routines, the weight element 110 may move from a first starting position (see, e.g. FIG. 16A) to a second exercise position (see, e.g. 16B), and return again to the starting position along substantially the same arcuate path AP1 in the same plane of stable motion MP1 (recognizing that the path may slightly deviate based on the ability of the user to follow the exact path and plane of stable motion). The weight element 110 moves in two different directions between the starting and exercise positions shown. In other possible exercise routines, the weight element 110 may return to the starting position along a different arcuate path and plane of stable motion (e.g. AP2-MP2 or other) to vary the exercise routine. The present exercise suspension system 20 allows the user to maintain contact with the weight element 110 as it is guided along the arcuate path AP1 from the starting position to exercise position, or alternatively to even release and break contact with the weight element by throwing the weight as seen in FIGS. 19 and 23. In either case, the weight element 110 is still supported and guided by suspension strap assembly 22 causing the weight element to travel along the arcuate path of motion like a pendulum.

While the foregoing description and drawings represent exemplary ("example") embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A method for exercising using an exercise suspension system with tethered weight, the method comprising:

providing a length-adjustable suspension strap assembly attached at one end to a fixed overhead support structure and at an opposite end to a detachable weight element, the suspension strap assembly comprising a plurality of straps detachably connected together, wherein the weight element is suspended from the overhead support structure creating a tensile force in the suspension strap assembly;

manually moving the weight element in a first direction from a first position to a second position along a first arcuate path in a first plane of stable motion; and returning the weight element from the second position to the first position;

wherein the weight is supported and guided during movement along the first arcuate path by the suspension strap assembly;

wherein the plurality of straps comprise:

an elongated adjustment strap forming a permanently closed continuous loop including a top end terminated with a first carabiner and a lower section slideably threaded through a selectively lockable adjustment side of a cam buckle, and a connector strap having a top end fixedly attached to a fixed side of the cam buckle and a bottom end terminated with a loop; and a weight strap including a top end terminated with a second carabiner and a permanently closed continuous securement loop extending downwards from the top end of the weight strap;

wherein the second carabiner of the weight strap is detachably coupled to the loop at the bottom end of the lower portion of the adjustable strap, and the securement loop of the weight strap is wrapped around the weight element and the second carabiner is threaded back through the securement loop forming a tightenable slip knot which secures the weight element to the weight strap.

2. The method according to claim 1, wherein the tensile force is maintained in the suspension strap assembly by the weight element during movement between the first and second positions keeping the suspension strap assembly in a taut condition during movement.

3. The method according to claim 2, wherein the weight maintains a substantially linear configuration of the suspension strap assembly during movement between the first and second positions.

4. The method according to claim 3, wherein the weight element moves via a pendulum motion along the first arcuate path between the first and second positions created by the tensile force in the suspension strap assembly.

5. The method according to claim 4, wherein the weight element is entirely supportable by the suspension strap assembly from the fixed overhead support object without assistance by a user.

6. The method according to claim 1, wherein the weight element is returned from the second position to the first position along the same first arcuate path in the first plane of stable motion.

7. The method according to claim 1, wherein the weight element is returned from the second position to the first position along a second arcuate path in a second plane of stable motion different than the first arcuate path and the first plane of stable motion.

8. The method according to claim 1, wherein a user maintains continuous contact with the weight element when manually moving the weight element from the first position to the second position along the first arcuate path.

9. The method according to claim 1, wherein the user throws and swings the weight element from the first position and the second position along the first arcuate path, the weight element returning to the first position with a pendulum-like motion.

10. The method according to claim 8, wherein the first position is proximal to the user and the second position is distal to the user.

11. The method according to claim 8, wherein the first position is distal to the user and the second position is proximal to the user.

12. The method according to claim 1, wherein the plurality of straps further comprise an extension strap including a first end terminated with a D-ring and a second end terminated with a loop, and wherein a medial portion of the extension strap between the first and second ends is wrapped around the overhead support structure and the D-ring and loop of the extension strap are each coupled to the first carabiner of the adjustment strap.

13. A method for exercising using an exercise suspension system with tethered weight, the method comprising:

providing a length-adjustable suspension strap assembly attached at one end to a fixed overhead support structure, the suspension strap assembly comprising a plurality of flexible straps including:

(i) an elongated adjustable strap sub-assembly comprising:

an adjustment strap including a top end terminated with a first carabiner and a lower section slideably threaded through a selectively lockable adjustment side of a cam buckle, and a connector strap having a top end fixedly attached to a fixed side of the cam buckle and a bottom end terminated with a loop;

(ii) an extension strap including a first end terminated with a D-ring and a second end terminated with a loop, and wherein a medial portion of the extension strap between the first and second ends is wrapped around the overhead support structure, and the D-ring and loop of the extension strap are each coupled to the first carabiner of the adjustment strap;

(iii) a weight strap including a top end terminated with a second carabiner coupled to the connector strap of the adjustable suspension strap assembly and a permanently closed continuous securement loop extending downwards from the top end of the weight strap; and (iv) a weight element suspended from the weight strap and creating a tensile force which forms a taut condition of the suspension strap assembly;

manually moving the weight element in a first direction from a first position to a second position along a first arcuate path in a first plane of stable motion; and returning the weight element from the second position to the first position;

wherein the weight is supported and guided during movement along the first arcuate path by the suspension strap assembly.

14. The method according to claim 13, wherein the weight element is entirely supportable by the suspension strap assembly from the fixed overhead support object without assistance by a user.

15. The method according to claim 14, wherein the tensile force is maintained in the suspension strap assembly by the weight element during movement between the first and second positions keeping the suspension strap assembly in the taut condition during movement.

16. The method according to claim 15, wherein the weight element moves via a pendulum motion along the first arcuate path between the first and second positions created by the tensile force in the suspension strap assembly.

17. The method according to claim 13, wherein the cam buckle is movable between an unlocked position and a locked position, and wherein the adjustment strap is slideable through the cam buckle when in the unlocked position for adjusting the length of the adjustment strap and lockable to cam buckle when in the locked position to fix the length of the strap.

18. The method according to claim 13, wherein a user maintains contact with the weight element during manually moving the weight element along the first arcuate path.

19. A method for exercising using an exercise suspension system with tethered weight, the method comprising:

providing a length-adjustable suspension strap assembly attached at one end to a fixed overhead support structure, the suspension strap assembly comprising a plurality of flexible straps including:

(i) an elongated length adjustable strap sub-assembly comprising:

an adjustment strap forming a permanently closed continuous loop, the adjustment strap including a top end terminated with a first carabiner and a lower section slideably threaded through a selectively lockable adjustment side of a cam buckle, and a connector strap having a top end fixedly attached to a fixed side of the cam buckle and a bottom end terminated with a loop;

(ii) a weight strap including a top end terminated with a second carabiner coupled to the connector strap of the adjustable suspension strap assembly and a permanently closed continuous securement loop extending downwards from the top end of the weight strap; and (iii) a weight element suspended from the weight strap and creating a tensile force which forms a taut condition of the suspension strap assembly;

manually moving the weight element in a first direction from a first position to a second position along a first arcuate path in a first plane of stable motion while maintaining the taut condition of the suspension strap assembly; and returning the weight element from the second position to the first position;

wherein the weight is supported and guided during movement along the first arcuate path by the suspension strap assembly.

20. The method according to claim 19, further comprising (iv) an extension strap including a first end terminated with a D-ring and a second end terminated with a loop, and wherein the method further includes wrapping a medial portion of the extension strap between the first and second ends around the overhead support structure, and coupling the D-ring and loop of the extension strap to the first carabiner of the adjustment strap.

21. The method according to claim 19, wherein the moving step entails moving the weight element via a pendulum motion along the first arcuate path between the first and second positions such that the weight element is continuously supported at least partially by the suspension strap assembly.

22. The method according to claim 19, wherein the weight element is selected from the group consisting of a kettlebell, a weight plate, and a dumbbell.

* * * * *